US012529368B2

(12) United States Patent
Nguyen et al.

(10) Patent No.: US 12,529,368 B2
(45) Date of Patent: Jan. 20, 2026

(54) PERISTALTIC PUMP WITH OFFSET ROLLERS HAVING DIFFERENT SIZED DIAMETERS

(71) Applicant: Blue-White Industries, Ltd., Huntington Beach, CA (US)

(72) Inventors: John T. Nguyen, Fountain Valley, CA (US); Patrick Michael Murphy, Irvine, CA (US); Robert E. Gledhill, III, Huntington Beach, CA (US); Phong Thanh Phan, Garden Grove, CA (US); Thomas Tran, Fountain Valley, CA (US); Hipolito Camacho, Whittier, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 0 days.

(21) Appl. No.: 18/468,545

(22) Filed: Sep. 15, 2023

(65) Prior Publication Data

US 2024/0110559 A1 Apr. 4, 2024

Related U.S. Application Data

(60) Provisional application No. 63/377,975, filed on Sep. 30, 2022.

(51) Int. Cl.
*F04B 43/12* (2006.01)

(52) U.S. Cl.
CPC ..... *F04B 43/1292* (2013.01); *F04B 43/1253* (2013.01)

(58) Field of Classification Search
CPC ... F04B 43/1253; F04B 43/1292; F04B 43/12
See application file for complete search history.

(56) References Cited

U.S. PATENT DOCUMENTS 3,429,273 A * 2/1969 Jones, Jr. ..... F04B 43/1215 417/477.13
4,060,348 A * 11/1977 Della Bianca ..... F04B 43/1276 417/477.3

(Continued)

FOREIGN PATENT DOCUMENTS

CN 102878064 A 1/2013
CN 204646605 U * 9/2015

(Continued)

OTHER PUBLICATIONS

English Machine Translation of FR-2595765-A (Year: 1987).*

*Primary Examiner* — Nathan C Zollinger
(74) *Attorney, Agent, or Firm* — Knobbe, Martens, Olson & Bear, LLP

(57) ABSTRACT

A rotor assembly for a peristaltic pump is provided. Each of a first pair of roller assemblies includes a first roller portion having a first diameter and a second roller portion having a second diameter. The first diameter is larger than the second diameter. Each of a second pair of roller assemblies includes a first roller portion having a first diameter and a second roller portion having a second diameter. The first diameter is smaller than the second diameter. The first and second pairs of roller assemblies are positionable around a circumference of a hub such that the first roller portion of the first pair of roller assemblies is aligned with the first roller portion of the second pair of roller assemblies and the second roller portion of the first pair of roller assemblies is aligned with the second roller portion of the second pair of roller assemblies.

6 Claims, 19 Drawing Sheets

(56) References Cited

U.S. PATENT DOCUMENTS

| | | | | |
|---|---|---|---|---|
| 4,558,996 | A | 12/1985 | Becker | |
| 4,705,464 | A | 11/1987 | Arimond | |
| 5,064,358 | A * | 11/1991 | Calari | F04B 43/1292 604/153 |
| 7,001,153 | B2 | 2/2006 | McDowell et al. | |
| 7,284,964 | B2 | 10/2007 | McDowell et al. | |
| 8,215,931 | B2 | 7/2012 | McDowell et al. | |
| 8,418,364 | B2 | 4/2013 | McDowell et al. | |
| 8,639,363 | B2 | 1/2014 | Gledhill, III et al. | |
| 9,374,024 | B2 | 6/2016 | Nguyen et al. | |
| 9,389,109 | B2 | 7/2016 | Gledhill, III et al. | |
| 9,777,720 | B2 | 10/2017 | Gledhill, III et al. | |
| 9,828,984 | B2 | 11/2017 | Gledhill, III et al. | |
| 9,909,579 | B2 | 3/2018 | Gledhill, III et al. | |
| 9,996,089 | B2 | 6/2018 | Gledhill, III et al. | |
| 10,330,094 | B2 | 6/2019 | Gledhill, III et al. | |
| 10,371,137 | B2 * | 8/2019 | Himmelmann | F04B 43/1292 |
| 10,724,513 | B2 | 7/2020 | Mead et al. | |
| 10,948,320 | B2 | 3/2021 | Gledhill, III et al. | |
| 11,131,300 | B2 | 9/2021 | Gledhill, III et al. | |
| 11,150,118 | B2 | 10/2021 | Gledhill, III et al. | |
| 11,221,004 | B2 | 1/2022 | Gledhill, III et al. | |
| 11,261,857 | B2 | 3/2022 | Gledhill, III et al. | |
| D959,238 | S | 8/2022 | Nguyen et al. | |
| 11,402,248 | B2 | 8/2022 | Gledhill, III et al. | |
| 11,485,653 | B2 | 11/2022 | Gledhill, III et al. | |
| 11,578,716 | B2 | 2/2023 | Gledhill, III et al. | |
| 11,639,863 | B2 | 5/2023 | Nguyen et al. | |
| 11,703,362 | B2 | 7/2023 | Nguyen et al. | |
| 11,754,065 | B2 | 9/2023 | Nguyen et al. | |
| 11,768,092 | B2 | 9/2023 | Gledhill, III et al. | |
| 11,768,929 | B2 | 9/2023 | Gledhill, III et al. | |
| 11,781,709 | B2 | 10/2023 | Nguyen et al. | |
| 11,891,989 | B2 | 2/2024 | Gledhill, III et al. | |
| 11,898,546 | B2 | 2/2024 | Gledhill, III et al. | |
| 11,939,972 | B2 | 3/2024 | Nguyen et al. | |
| D1,030,452 | S | 6/2024 | Nguyen et al. | |
| 12,044,354 | B2 | 7/2024 | Nguyen et al. | |
| 12,049,887 | B2 | 7/2024 | Nguyen et al. | |
| 12,135,023 | B2 | 11/2024 | Murphy et al. | |
| 12,264,663 | B2 | 4/2025 | Gledhill, III et al. | |
| 12,281,922 | B2 | 4/2025 | Gledhill, III et al. | |
| 12,298,161 | B2 | 5/2025 | Nguyen et al. | |
| 12,339,145 | B2 | 6/2025 | Nguyen et al. | |
| 12,353,539 | B2 | 7/2025 | Gledhill, III et al. | |
| 2007/0031272 | A1 | 2/2007 | Ramirez, Jr. et al. | |
| 2010/0005655 | A1 | 1/2010 | Nguyen | |
| 2011/0180172 | A1 | 7/2011 | Gledhill, III et al. | |
| 2012/0100023 | A1 | 4/2012 | Hanazuka et al. | |
| 2014/0127063 | A1 | 5/2014 | Petersen et al. | |
| 2015/0037188 | A1 | 2/2015 | Tuckey | |
| 2015/0211509 | A1 | 7/2015 | Gledhill, III et al. | |
| 2018/0291886 | A1 | 10/2018 | Gledhill, III et al. | |
| 2018/0298891 | A1 | 10/2018 | Gledhill, III et al. | |
| 2021/0054963 | A1 | 2/2021 | Nguyen et al. | |
| 2021/0348602 | A1 | 11/2021 | Nguyen et al. | |
| 2022/0099083 | A1 | 3/2022 | Gledhill, III et al. | |
| 2022/0316463 | A1 | 10/2022 | Gledhill, III et al. | |
| 2023/0287881 | A1 | 9/2023 | Murphy et al. | |
| 2023/0417364 | A1 | 12/2023 | Nguyen et al. | |
| 2023/0417582 | A1 | 12/2023 | Nguyen et al. | |
| 2024/0003343 | A1 | 1/2024 | Nguyen et al. | |
| 2024/0003724 | A1 | 1/2024 | Nguyen et al. | |
| 2024/0011479 | A1 | 1/2024 | Gledhill, III et al. | |
| 2024/0028694 | A1 | 1/2024 | Gledhill, III et al. | |
| 2024/0254983 | A1 | 8/2024 | Nguyen et al. | |
| 2024/0271612 | A1 | 8/2024 | Murphy et al. | |
| 2024/0392770 | A1 | 11/2024 | Anderson et al. | |
| 2024/0401581 | A1 | 12/2024 | Gledhill, III et al. | |
| 2025/0172135 | A1 | 5/2025 | Nguyen et al. | |
| 2025/0172236 | A1 | 5/2025 | Nguyen et al. | |
| 2025/0237536 | A1 | 7/2025 | Gledhill, III et al. | |
| 2025/0264098 | A1 | 8/2025 | Murphy et al. | |

FOREIGN PATENT DOCUMENTS

| | | | | |
|---|---|---|---|---|
| CN | 222976998 U * | 6/2025 | | |
| EP | 3290696 A1 * | 3/2018 | | B64G 1/60 |
| FR | 2595765 A * | 9/1987 | | F04B 11/005 |
| GB | 2385096 A * | 8/2003 | | F04B 11/005 |
| GB | 2553536 A * | 3/2018 | | A61M 1/0281 |
| WO | WO 2021/078900 A1 | 4/2021 | | |
| WO | WO 2021/078902 A1 | 4/2021 | | |
| WO | WO 2021/089762 A1 | 5/2021 | | |

* cited by examiner

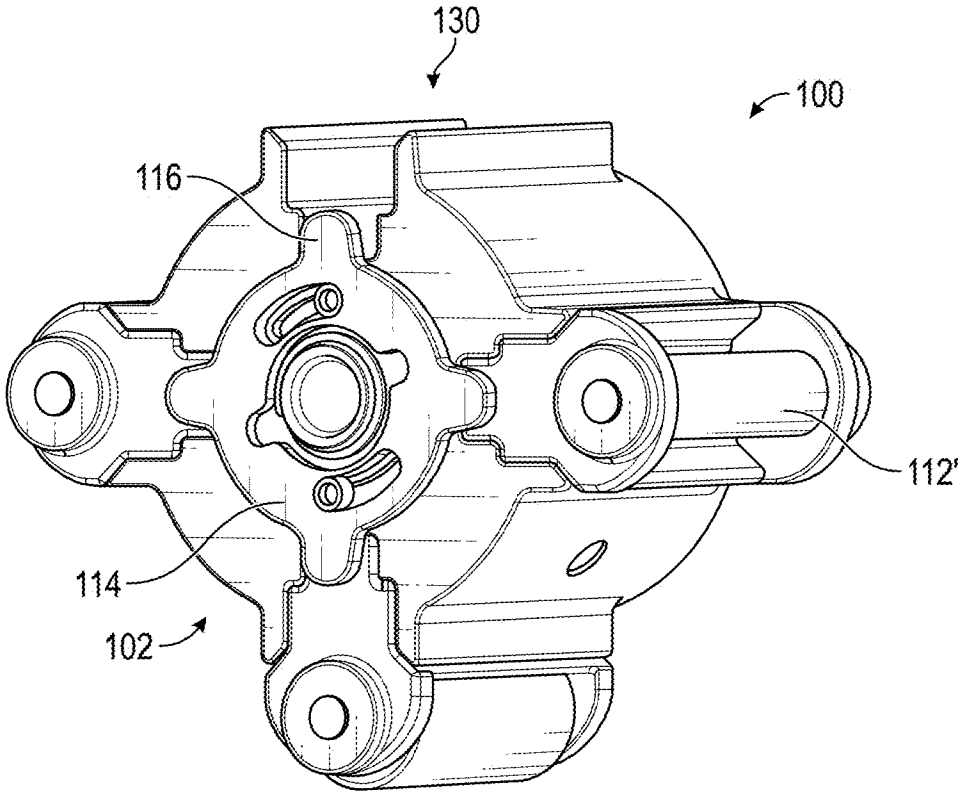
FIG. 3C
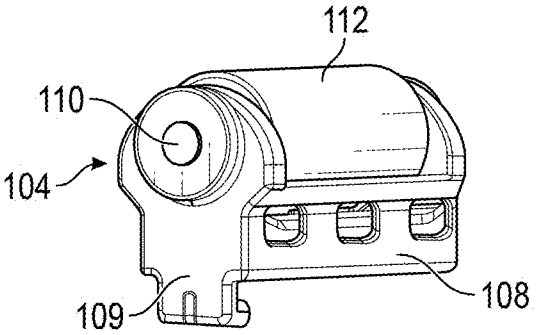

PERISTALTIC PUMP WITH OFFSET ROLLERS HAVING DIFFERENT SIZED DIAMETERS

INCORPORATION BY REFERENCE

This application claims priority to U.S. Provisional Application No. 63/377,975, filed Sep. 30, 2022, entitled "PUMP WITH OFFSET ROLLERS." This application is related to U.S. application Ser. No. 17/306,697, filed May 3, 2021, entitled "ROTOR ASSEMBLY WITH REMOVABLE ROLLERS," which claims priority to U.S. Provisional Application No. 63/020,720, filed May 6, 2020, entitled "ROTOR ASSEMBLY WITH REMOVABLE ROLLERS." The disclosure of each application referenced in this paragraph is hereby incorporated by reference in its entirety and is a part of this application. In addition, the Appendix filed herewith forms part of the specification of this application.

BACKGROUND

Field

Certain embodiments discussed herein relate to methods, systems, and devices for pumping with a peristaltic pump.

Discussion of the Related Art

Peristaltic pumps pump fluids or slurries without the fluid or slurry coming into direct contact with the pump. The peristaltic pump head has rollers that pinch a portion of tubing between the roller and a housing that surrounds the pump head. As the pump head rotates, the tubing pinch point moves along the tubing and drives fluid within the tubing ahead of the pinch point. In this way, peristaltic pumps can pump fluids or slurries without making contact with the pumped material.

SUMMARY

The systems, methods and devices described herein have innovative aspects, no single one of which is indispensable or solely responsible for their desirable attributes. Without limiting the scope of the present disclosure, some of the advantageous features will now be summarized.

Aspects of the present disclosure relate to apparatuses and methods for peristaltic pumping applications. In some variants, a peristaltic pump assembly is provided herein. In some aspects, the peristaltic pump assembly includes a pump head, a motor having a drive shaft, and a rotor connectable to the drive shaft so as to be rotatable therewith. The pump head can include a first station and a second station. The first station can include (1) a first tube portion configured to receive a first tube and/or a first tube connector section and (2) a second tube portion configured to receive a second tube and/or a second tube connector section. The second station can include (1) a first tube portion configured to receive a first tube and/or a first tube connector section and (2) a second tube portion configured to receive a second tube and/or a second tube connector section. The pump head can also include a first outer tube interface surface portion positioned to contact a first tube extending between the first station and the second station. The pump head can also include a second outer tube interface surface portion positioned to contact a second tube extending between the first station and the second station.

In various implementations, the rotor can include a first pair of roller assemblies and a second pair of roller assemblies. Each of the first pair of roller assemblies can include a first roller portion having a first diameter and a second roller portion having a second diameter. The first diameter can be larger than the second diameter. Each of the second pair of roller assemblies can include a first roller portion having a first diameter and a second roller portion having a second diameter. The first diameter can be smaller than the second diameter.

In various implementations, the first pair of roller assemblies and the second pair of roller assemblies can be positionable around a circumference of the rotor such that each one of the first pair of roller assemblies can be positioned between the second pair of roller assemblies, and the first roller portion of the first pair of roller assemblies can be aligned with the first roller portion of the second pair of roller assemblies and the second roller portion of the first pair of roller assemblies can be aligned with the second roller portion of the second pair of roller assemblies.

In various implementations, the first roller portion of the first pair of roller assemblies and the first roller portion of the second pair of roller assemblies can be configured to selectively compress tubing against the first outer tube interface surface and the second roller portion of the first pair of roller assemblies and the second roller portion of the second pair of roller assemblies can be configured to selectively compress tubing against the second outer tube interface surface.

In some aspects, the first roller portion and the second roller portion of each of the first pair of roller assemblies can be connected to rotate together and the first roller portion and the second roller portion of each of the second pair of roller assemblies can be connected to rotate together.

In some aspects, the first roller portion and the second roller portion of each of the first pair of roller assemblies can form a continuous integral piece and the first roller portion and the second roller portion of the second pair of roller assemblies can form a continuous integral piece.

In some instances, (1) the combined axial width of the first roller portion and the second roller portion of the first pair of roller assemblies can be at least 70% of the axial width of the first tube station and (2) the combined axial width of the first roller portion and the second roller portion of the second pair of roller assemblies can be least 70% of the axial width of the second tube station.

In some designs, the rotor can comprise a hub comprising at least a first pair of hub interface surfaces that extend longitudinally along the hub. Each of the first pair of roller assemblies can comprise a first support frame, a first axle and a first roller. Each of the first pair of first roller assemblies can further comprise a first roller assembly interface surface configured to slide longitudinally along one of the first pair of hub interface surfaces to seat one of the first pair of roller assemblies onto the hub.

In some designs, the rotor can comprise a hub further comprising at least a second pair of hub interface surfaces that extend longitudinally along the hub. Each of the second pair of roller assemblies can comprise a second support frame, a second axle and a second roller. Each of the second pair of second roller assemblies can further comprise a second roller assembly interface surface configured to slide longitudinally along one of the second pair of hub interface surfaces to seat one of the second pair of roller assemblies onto the hub.

In some variants, a peristaltic pump assembly can include a pump head, a motor having a drive shaft, and a rotor connectable to the drive shaft so as to be rotatable therewith.

The pump head can include a first station and a second station. The first station can include (1) a first tube portion configured to receive a first tube and/or a first tube connector section and (2) a second tube portion configured to receive a second tube and/or a second tube connector section. The second station can include (1) a first tube portion configured to receive a first tube and/or a first tube connector section and (2) a second tube portion configured to receive a second tube and/or a second tube connector section. The pump head can also include a first outer tube interface surface portion positioned to contact a first tube extending between the first station and the second station. The pump head can also include a second outer tube interface surface portion positioned to contact a second tube extending between the first station and the second station.

In various implementations, the rotor can include a first pair of roller assemblies and a second pair of roller assemblies. Each of the first pair of roller assemblies can include a first roller seat having a first minimum diameter and a second roller seat having a second minimum diameter. The first minimum diameter can be larger than the second minimum diameter. Each of the second pair of roller assemblies can include a first roller seat having a first minimum diameter and a second roller seat having a second minimum diameter. The first minimum diameter can be smaller than the second minimum diameter.

In various implementations, the first pair of roller assemblies and the second pair of roller assemblies can be positionable around a circumference of the rotor such that the first roller seat of the first pair of roller assemblies can be aligned with the first roller seat of the second pair of roller assemblies and the second roller seat of the first pair of roller assemblies can be aligned with the second roller seat of the second pair of roller assemblies.

In various implementations, the first roller seat of the first pair of roller assemblies and the first roller seat of the second pair of roller assemblies can be configured to selectively compress tubing against the first outer tube interface surface and the second roller seat of the first pair of roller assemblies and the second roller seat of the second pair of roller assemblies can be configured to selectively compress tubing against the second outer tube interface surface.

In some aspects, each of the first roller seat and the second roller seat of the first pair of roller assemblies can be connected to rotate together and each of the first roller seat and the second roller seat of the second pair of roller assemblies can be connected to rotate together.

In some aspects, each of the first roller seat and the second roller seat of the first pair of roller assemblies can form a continuous integral piece and each of the first roller seat and the second roller seat of the second pair of roller assemblies can form a continuous integral piece.

In some instances, (1) the combined axial width of the first roller seat and the second roller seat of the first pair of roller assemblies can be at least 80% of the axial width of the first tube station and (2) the combined axial width of the first roller seat and the second roller seat of the second pair of roller assemblies can be at least 80% of the axial width of the second tube station.

In some designs, the rotor can comprise a hub comprising at least a first pair of hub interface surfaces that extend longitudinally along the hub. Each of the first pair of roller assemblies comprises a first support frame, a first axle and a first roller. Each of the first pair of first roller assemblies can further comprise a first roller assembly interface surface configured to slide longitudinally along one of the first pair of hub interface surfaces to seat one of the first pair of roller assemblies onto the hub.

In some designs, the hub can further comprise at least a second pair of hub interface surfaces that extend longitudinally along the hub. Each of the second pair of roller assemblies comprises a second support frame, a second axle and a second roller. Each of the second pair of second roller assemblies can further comprise a second roller assembly interface surface configured to slide longitudinally along one of the second pair of hub interface surfaces to seat one of the second pair of roller assemblies onto the hub.

Any of the features, components, or details of any of the arrangements or embodiments disclosed in this application, including without limitation any of the rotor systems and any of the methods disclosed below, are interchangeably combinable with any other features, components, or details of any of the arrangements or embodiments disclosed herein to form new arrangements and embodiments.

BRIEF DESCRIPTION OF THE DRAWINGS

Throughout the drawings, reference numbers can be reused to indicate general correspondence between reference elements. The drawings are provided to illustrate example aspects described herein and are not intended to limit the scope of the disclosure.

FIG. 3C shows a roller assembly removed from the rotor assembly of FIG. 3A.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Figure 1A:
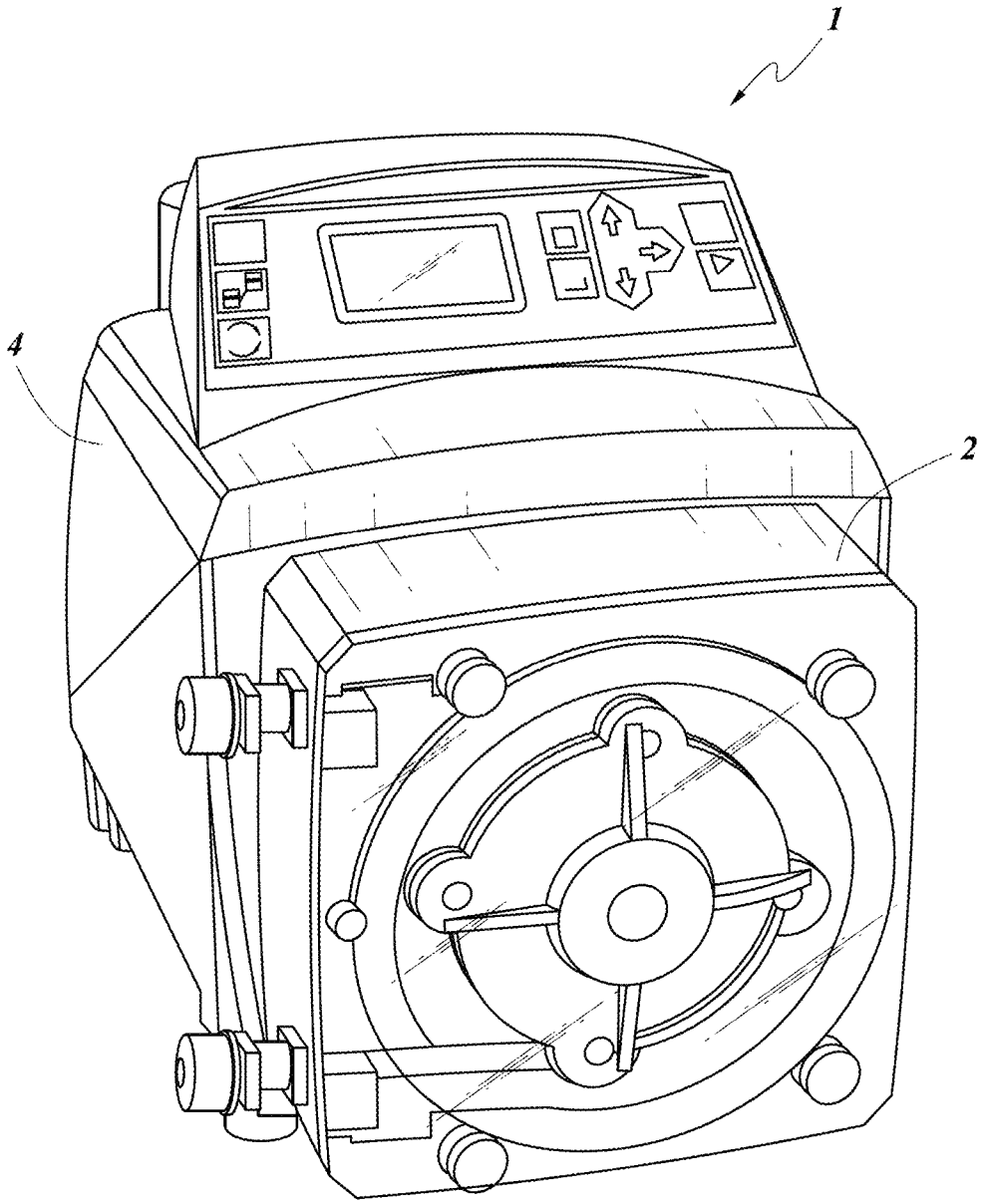
FIG. 1A is a perspective view of a peristaltic pump.
Figure 1B:
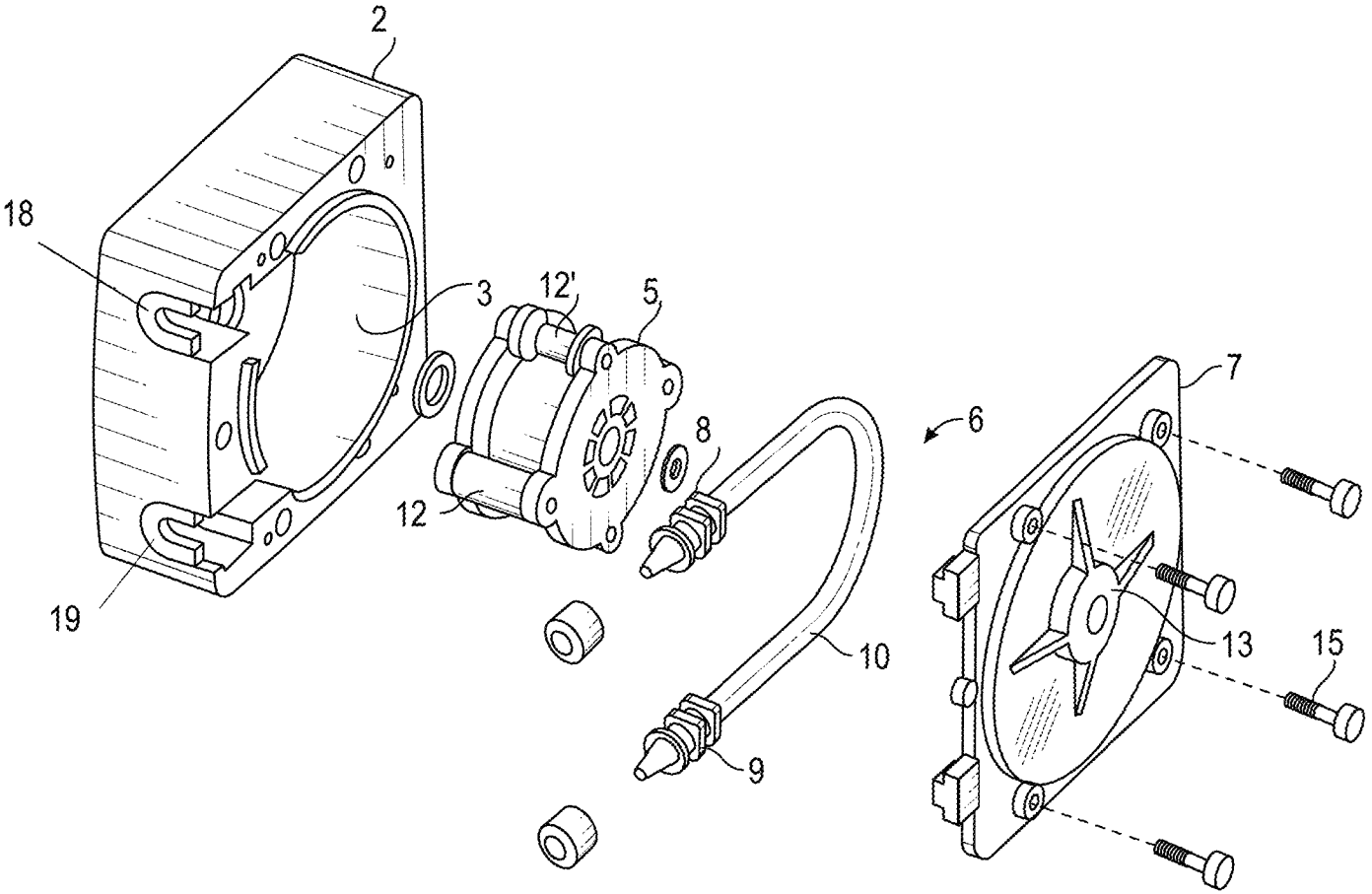
FIG. 1B is an exploded perspective view of components of a peristaltic pump.

FIG. 1A is a perspective view of an example peristaltic pump. The example pump 1 has a pump head 2 and a body housing 4. FIG. 1B is an exploded perspective view of components of the peristaltic pump. As illustrated, the peristaltic pump can comprise a pump head 2 comprising a cavity 3, a rotor 5 that rotates within the cavity 3 of the pump head 2, a tubing assembly 6, and a pump head cover 7 that encloses the rotor 5 and the tubing assembly 6 within the cavity 3 of the pump head 2. The pump head 2 can be formed such that the tubing assembly 6 is positioned in a loop. However, the pump head 2 can be formed such that the tubing assembly 6 passes in a straight line through the pump head 2. In other words, the pump head 2 can be configured such that the inlet or outlet ports formed therein provide for a loop or straight-line arrangement of the tubing assembly 6 within a tubing channel when installed therein.

The tubing assembly 6 can comprise a tube or tubing 10 having connectors 8, 9 that are disposed at the opposing ends of the tube 10. It is contemplated that the connectors 8, 9 may be modified and even omitted in some implementations.

The pump head 2 can include a housing having a first station 18 and a second station 19. The first station 18 can include a portion configured to receive a portion of the tube 10 and/or a section of the tube connector 8. The second station 19 can include a portion configured to receive a portion of the tube 10 and/or a section of the tube connector 9. In the embodiment illustrated in FIG. 1B, the tube 10 terminates within the pump head 2, so that the tube connector 8 can be connected to a second tube which may be wholly outside of the housing 2 and the tube connector 9 can be connected to a third tube which may be wholly outside of the housing 2.

The rotor 5 can comprise a plurality of rollers 12, 12' that compress a tube 10 of the tubing assembly 6 within the pump head 2 in order to force fluid through the tube 10. The rotor 5 can rotate in a clockwise or counterclockwise direction. As will be appreciated, fluid in the tube 10 can be urged within the tube 10 along the direction of travel of the rollers 12, 12'.

As shown in FIG. 1B, the rollers can comprise at least one compression roller 12. The compression roller 12 can be configured to compress or pinch the tube 10 against an interior surface of the pump head 2 as the roller 12 rotates within the pump head 2. The compression or pinching of the tube 10 occurs along a length of the tube 10 as the compression roller 12 rotates. The movement and compression urges material disposed within the tube 10 to move through the tube 10 in the direction of rotation of the roller 12. Thus, the compression roller 12 can serve to urge fluid or other material through the tube 10 in the direction of the roller's rotation.

As shown in FIG. 1B, in some implementations, the rollers can comprise at least one alignment roller 12'. The alignment roller 12' can be formed to comprise a smaller diameter in a central portion thereof and a larger diameter along sides of the roller 12'. In this manner, the roller 12' can be configured to maintain the tube 10 within a gap between the roller 12' and a wall of the pump head 2. The shape of the roller 12' can allow the tube 10 to be urged toward a center of the roller 12' by side edges thereof.

In some implementations, an axle support portion 13 can provide support to an axle (e.g., a drive shaft extending from the motor) of the rotor 5. To install the tubing assembly 6, one usually removes the fasteners 15 (e.g., screws) with a tool (e.g., screwdriver) to open the cover 7 and axle support portion 13 to expose the tubing assembly 6.

Figure 2A:
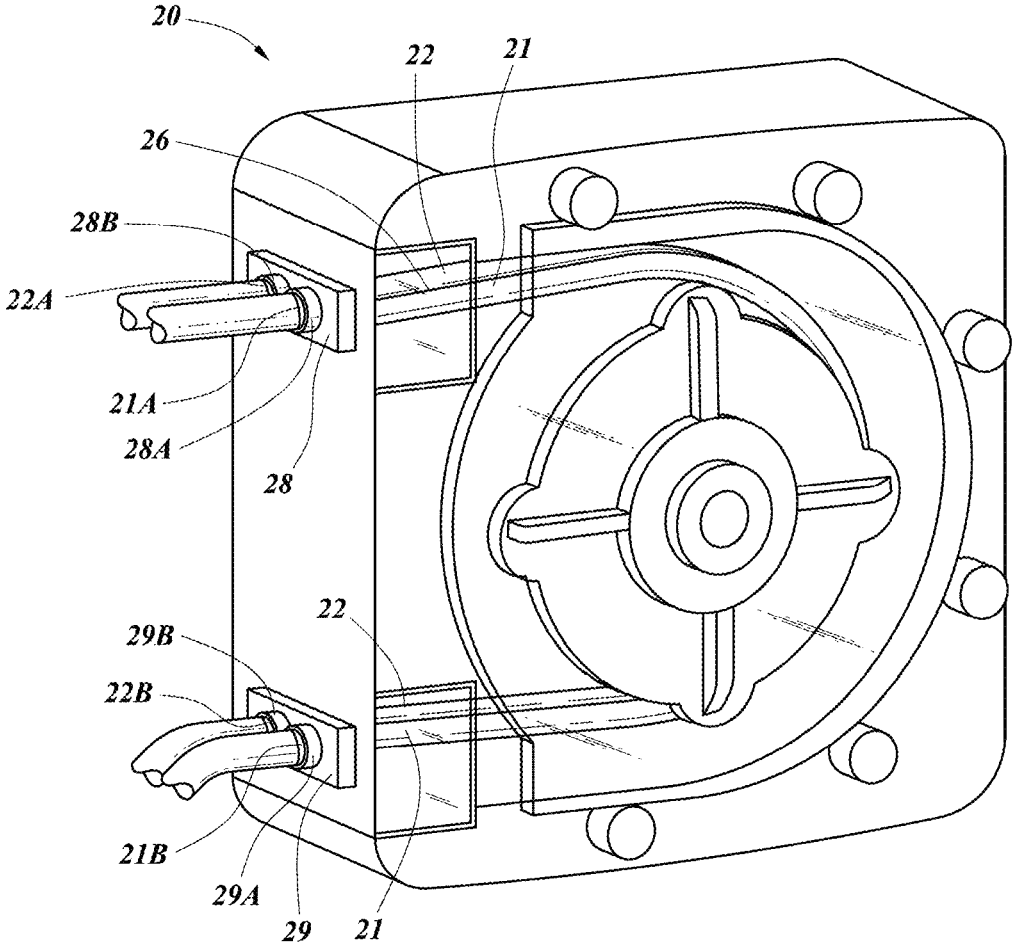
FIG. 2A is a perspective view of another example peristaltic pump.

FIG. 1B shows a tubing assembly 6 with a single tube 10. In other examples, a plurality of tubes can be used. FIG. 2A shows an example peristaltic pump 20 with a tubing assembly 26 with two tubes 21, 22. Other examples can have three, four, or more tubes. The plurality of tubes can allow the pump to have a plurality of inlets and/or outlets. The pump can include a first station 28 and a second station 29. The first station 28 can include (1) a first tube portion 28A configured to receive a first tube 21 and/or a first tube connector section 21A and (2) a second tube portion 28B configured to receive a second tube 22 and/or a second tube connector section 22A. The second station 29 can include (1) a first tube portion 29A configured to receive a first tube 21 and/or a first tube connector section 21B and (2) a second tube portion 29B configured to receive a second tube 22 and/or a second tube connector section 22B.

Figure 2B:
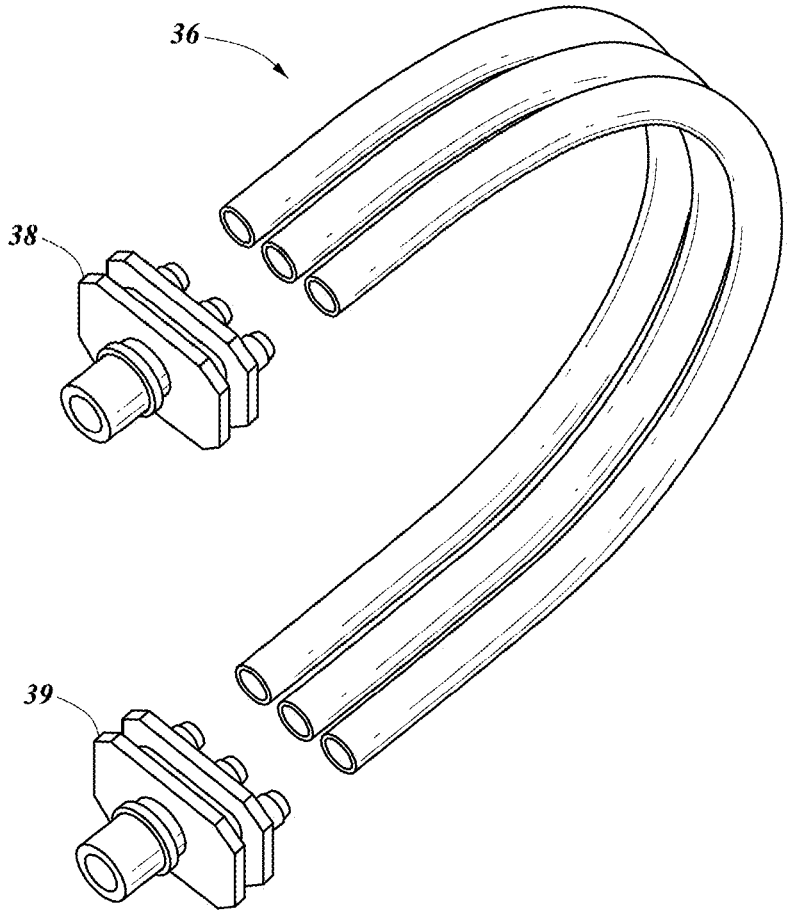
FIG. 2B shows an example tubing assembly and connectors for a peristaltic pump.

FIG. 2B shows an example of a tubing assembly 36 with a plurality of tubes that can be connected to a single inlet and/or outlet via adapters such as connectors 38, 39. Other examples are possible.

Removable Rollers

Figure 3A:
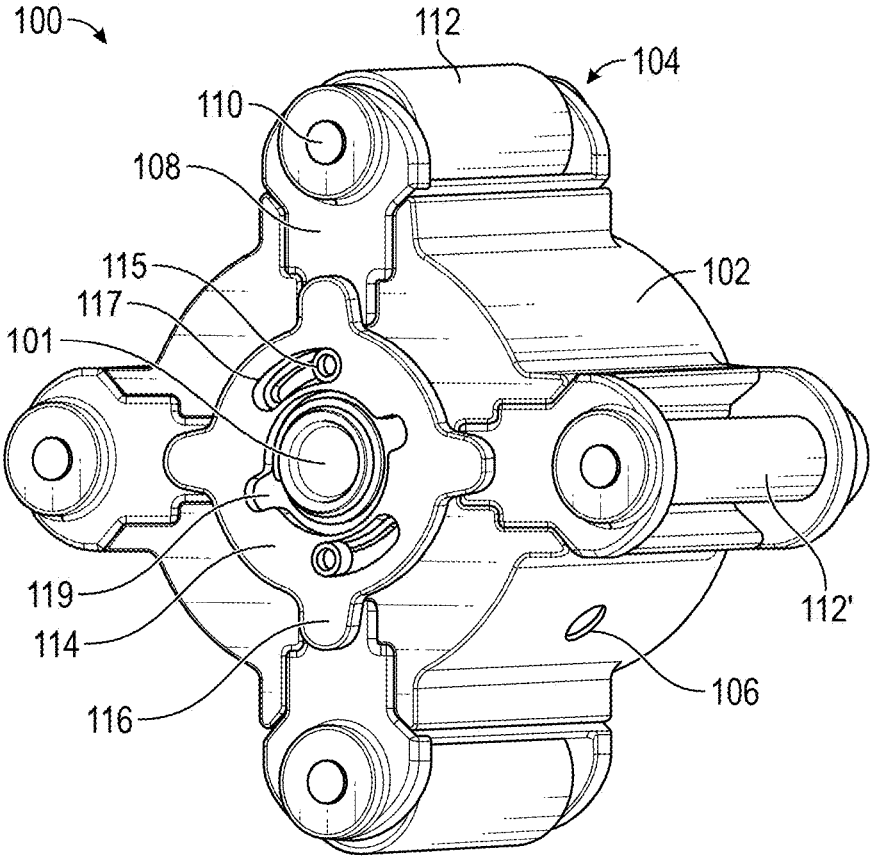
FIG. 3A shows a perspective partial front view of an embodiment of a rotor assembly according to some aspects of the present disclosure.

FIG. 3A shows an embodiment of a pump rotor assembly 100 according to some aspects of the present disclosure. The pump rotor assembly 100 can have a central opening 101 for mounting the pump rotor assembly 100 axially onto a drive shaft of a motor. The pump rotor assembly 100 can include a hub 102 and one or more roller assemblies 104. The hub 102 can be configured to couple with a drive shaft of a pump. In some aspects, the roller assembly 104 can be configured to attach to the hub 102 by sliding in an axial direction relative to the hub 102, as described herein. The hub 102 can include a fastening feature 106 that allows the hub 102 to be secured onto a drive shaft of a motor. In operation, the drive shaft of the motor can rotate the hub 102, and the roller assemblies 104 attached thereto, about the axis of the central opening 101.

With continued reference to FIG. 3A, the roller assembly 104 can include a support frame 108 that supports an axle 110. A roller 112 can be mounted on the axle 110. The rotor assembly 100 can include different diameter rollers 112, 112', as shown in FIG. 3A. The pump rotor assembly 100 can include a collar 114. The collar 114 can help secure the roller assembly 104 onto the hub 102, as described herein. The collar 114 can include a blocking surface, such as a protrusion or tab 116, that can be moved into a locked position wherein the tab 116 blocks the roller assembly 104 from moving axially relative to the hub 102. The tab 116 can be moved to an unlocked position or removed from the hub 102 such that the roller assembly 104 can be inserted onto, or removed from, the hub 102 in an axial direction. The collar 114 can be secured to the hub 102 by one or more collar fasteners 115. In the illustrated embodiment, a pair of diametrically opposed collar fasteners 115 are used to secure the collar 114 to the hub 102. The collar fastener 115 can be seated within an opening 117 defined by the collar 114, as shown in FIG. 3A. The collar 114 can include a tool interface, such as the illustrated recesses 119, that facilitates rotation of the collar 114. The fastener 115 can be configured to slide within the opening 117 to allow collar 114 to rotate in one direction only. In some aspects, a tool can be inserted into the recesses 119 to move the tab 116 into the locked configuration. In some aspects, the collar 114 can be rotated between the locked and unlocked configurations while maintaining the collar 114 connection to the hub 102. In some aspects, roller assemblies 104 can be attached to or removed from the hub 102 while maintaining the collar 114 connection to the hub 102. For example, the collar 114 can be removed from the hub or rotated to the unlocked configuration; a roller assembly 104 can be inserted onto the hub 102 in an axial direction; the collar 114 can be moved to the locked position such that the roller assembly 104 is blocked from moving relative to the hub 102 in the axial direction, thereby locking the roller assembly 104 onto the hub 102. As shown in FIG. 3A, the collar 114 can have a plurality of blocking surfaces, such as a plurality of tabs 116 that can each lock a roller assembly 104 into place on hub 102. The collar 114 may have more than two tabs 116, more than three tabs 116, more than four tabs 116, more than five tabs 116 or more than six tabs 116. The collar 114 may have less than three, four, five or six tabs 116. The collar 114 may include two to eight tabs 116, three to eight tabs 116, four to eight tabs 116, or three to six tabs 116.

Figure 3B:
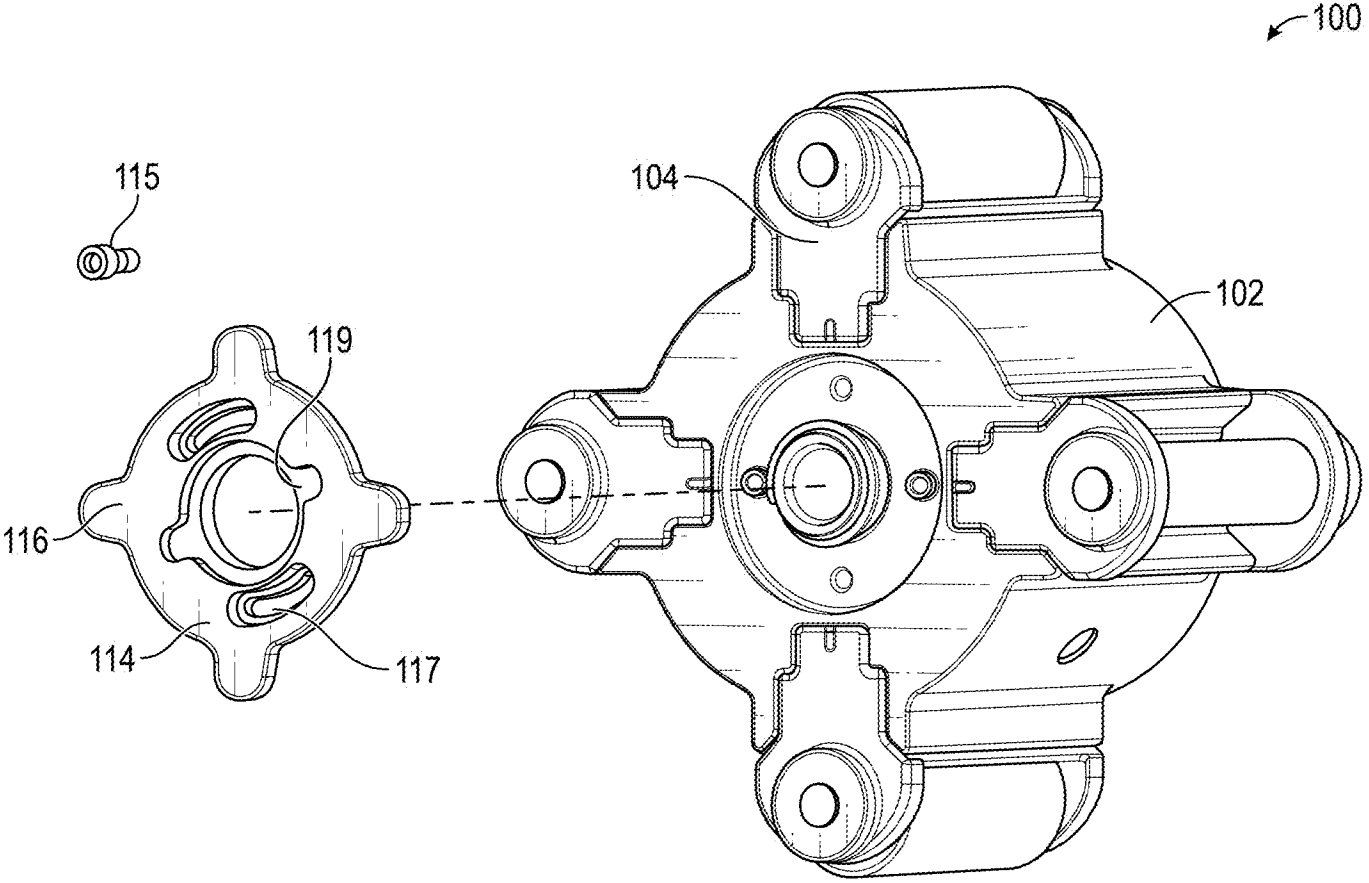
FIG. 3B shows an exploded view of the rotor assembly of FIG. 3A.

FIG. 3B shows the rotor assembly 100 with the collar 114 removed from hub 102. A fastener 115 can pass through the opening 117 to secure the collar 114 to the hub 102, as described herein. In some aspects, the rotor assembly 100 comprises a receiving portion disposed on the hub 102 that couples with a corresponding receiving structure disposed on the roller assembly 104 such that the roller assembly 104 can be reversibly coupled to the hub 102. In the illustrated embodiment, the hub 102 defines a slot-like interface structure that receives a corresponding interface portion defined by the frame 108 of the roller assembly 104.

FIG. 3C shows the rotor assembly 100 of FIG. 3A with one roller assembly 104 detached from the hub 102 and three roller assemblies 104 attached to the hub 102. The hub 102 can include an interface surface or structure that extends longitudinally along the hub 102. For example, the hub 102 can include an interface surface or structure that extends longitudinally along an outer surface of the hub 102. The roller assembly 104 can include an interface surface or structure configured to slide longitudinally along the interface surface or structure of the hub 102 to seat the roller assembly 104 onto the hub 102. As discussed, the hub 102 can include an interface surface or structure, such as a retaining portion (e.g., a receiving slot 130) that is configured to receive and retain a corresponding interface surface or structure, such as a retaining portion (e.g., frame 108) of the roller assembly 104. The hub retaining portion and the roller retaining portion can be configured to constrain the relative motion between the roller assembly 104 in the axial direction, the radial direction and/or the circumferential direction of the hub 102. The illustrated hub 102 has four retaining portions that are each configured to receive a roller assembly 104 inserted axially therein. For example, the illustrated hub 102 can include a receiving slot 130 that extends longitudinally along the hub 102, e.g., along an outer surface of the hub 102 or in an axial direction relative to the hub 102. A roller assembly 104 can be configured to slide along the receiving slot 130 to seat the roller assembly 104 onto the hub 102, e.g., longitudinally or in the axial direction along the receiving slot 130. In the illustrated embodiment, the roller assemblies 104 are equally spaced apart circumferentially on the hub 102. As discussed above, other numbers and arrangements of the roller assemblies 104 can be used. In some aspects, the rotor assembly 100 can include roller assemblies 104 that have different diameter rollers 112. For example, in the illustrated embodiment, the detached roller assembly 104 has a roller 112 that has a diameter that is greater than that of the roller 112' of the roller assemblies 104 that are immediately adjacent to the receiving slot 130 that has been vacated by the detached roller assembly 104. In various implementations, the rotor assembly 100 can include a lock (e.g., collar 114) configured to couple with the hub 102 and block the roller assembly 104 from moving longitudinally or in an axial direction along the interface surface or structure of the hub 102. As described herein, the collar 114 can be configured to couple with the hub 102 and block a roller assembly 104 from exiting a receiving slot 130. In FIG. 3C, the collar 114 is shown attached to the hub 102 in the locked configuration. As can be appreciated with reference to FIG. 3C, when the tab 116 is in the locked position, the tab 116 can overlap an arm portion 109 of the support frame 108 of the roller assembly 104 such that the roller assembly 104 is blocked from exiting the slot 130 in the axial direction.

Figure 4:
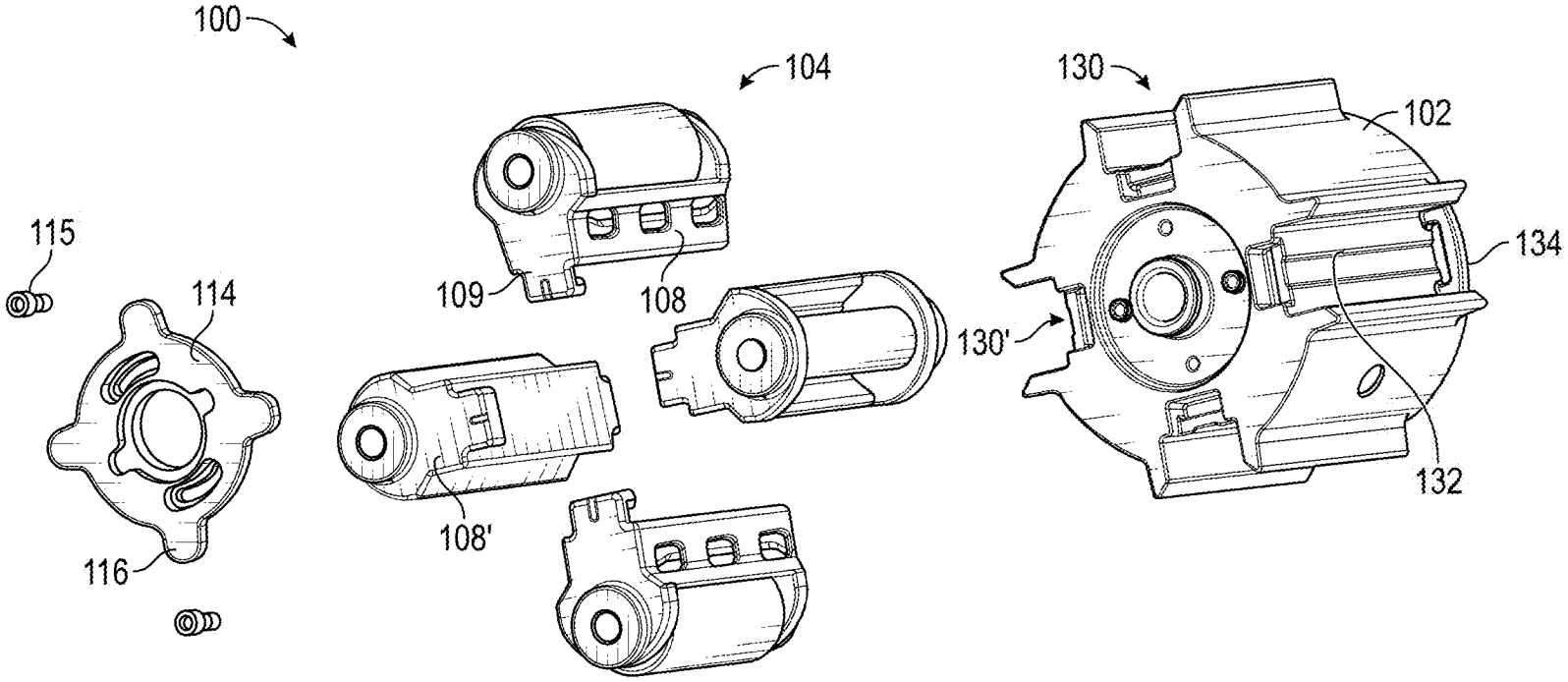
FIG. 4 shows an assembly view of the rotor assembly of FIG. 3A.

FIG. 4 shows an assembly view of the rotor assembly 100. In some aspects, the receiving portion of the hub 102 can include a track (e.g., a linear track) 132, as shown. The roller assembly 104 can be configured to slide along the linear track 132 in the axial direction to seat against a stop surface 134 at end of linear track 132. The stop surface 134 can be a unitary structure of hub 102. In some variants, the stop surface 134 can be removable from the hub 102.

Figure 5:
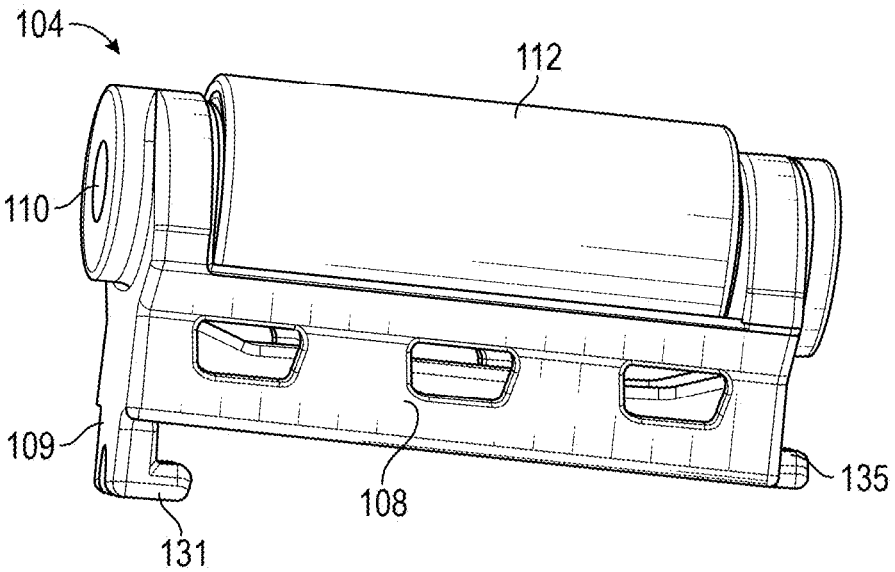
FIG. 5 shows a partial side view of a roller assembly according to some aspects of the present disclosure.

FIG. 5 shows a side view of a roller assembly 104. The roller assembly 104 has a roller 112 mounted on an axle 110 that is supported by the frame 108 of the roller assembly. The frame 108 can include features that help lock the roller assembly 104 onto the hub 102 so that the roller assembly 104 is fixed relative to the hub 102 in the axial direction, the radial direction, and the circumferential direction of the hub 102. As discussed, the frame 108 can include an arm portion 109 that is blocked from exiting the slot 130 in the axial direction by the tab 116 (FIG. 3C). The frame 108 can include a first seating portion, such as a hook 131. The hook 131 can be sized to fit within a first mating seat, such as recess 136 (FIG. 6) of the hub 102, as discussed herein. The frame 108 can include a second seating portion, such as a toe 135 (FIG. 5) which can be located on an opposite end of the frame 108 than the hook 131. The toe 135 can be sized to pass into or through second mating seat, such as an opening 140 (FIG. 6) of the stop surface 134, as described herein.

Figure 6:
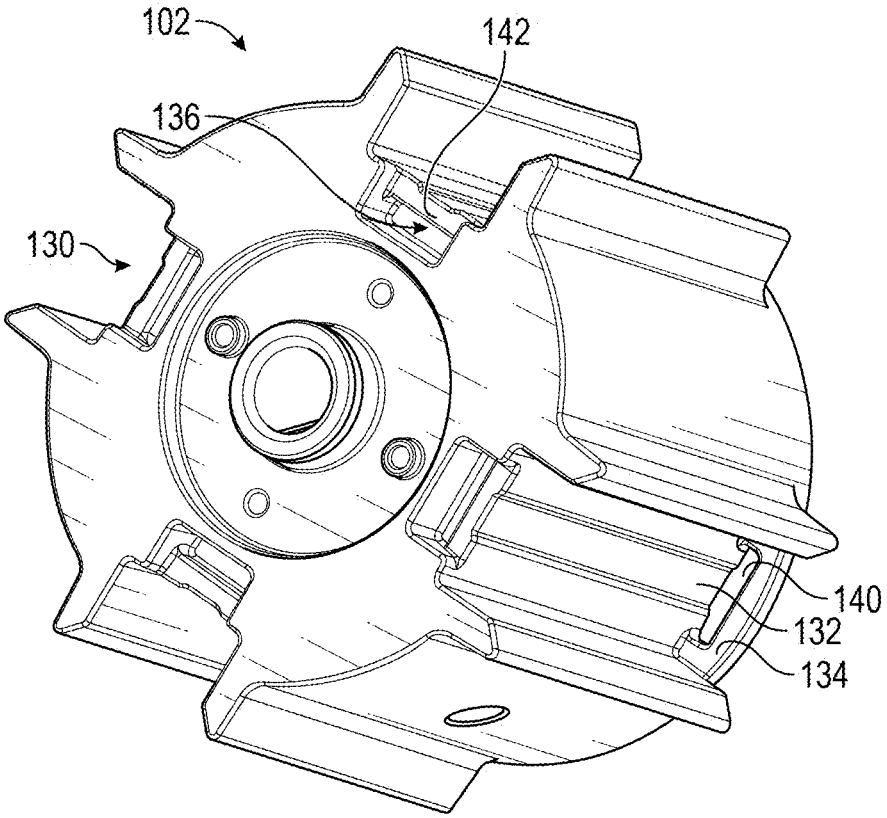
FIG. 6 shows a partial front and side view of a rotor hub according to some aspects of the present disclosure.

FIG. 6 shows a partial front and side view of the hub 102. The hub 102 can include a longitudinal track 132 that extends in an axial direction along an outer surface of the hub 102. In the illustrated embodiment, the longitudinal track 132 extends from the stop surface 134 to an abutment surface 142 at the opposing end of the longitudinal track 132. For example, the abutment surface 142 can face toward a first face of the hub 102. The track 132 can extend longitudinally away from the abutment surface 142. In some instances, the abutment surface 142 can be longitudinally recessed relative to the first face of the hub 102. In some instances, the abutment surface 142 can be disposed between the stop surface 134 and the first face of the hub 102. The stop surface 134 can span a gap between a pair of sidewalls of the receiving slot 130. The abutment surface 142 can contact the arm portion 109 of the roller assembly 104 when the roller assembly 104 is fully seated in the slot 130 of the receiving portion of the hub 102. The abutment surface 142 and the stop surface 134 can limit the axial movement of the roller assembly 104 along the slot 130 in a first axial direction. The tab 116 (FIG. 3C) of the collar 114 can limit the movement of the roller assembly in a second axial direction that is opposite the first axial direction. For example, the arm portion 109 of the roller assembly 104 can be configured to be captured between the collar 114 and the abutment surface 142 when the collar 114 blocks the roller assembly 104 from exiting the receiving slot 130. The frame 108 can be sized to fit into the track 132. The track 132 can be configured to guide the roller assembly 104 onto hub 102. In some aspects, the track 132 can guide the toe 135 into or through the opening 140 of the stop surface 134. In some variants, the toe 135 can be received within a recess or dead end opening rather than the illustrated opening 140.

Figure 7:
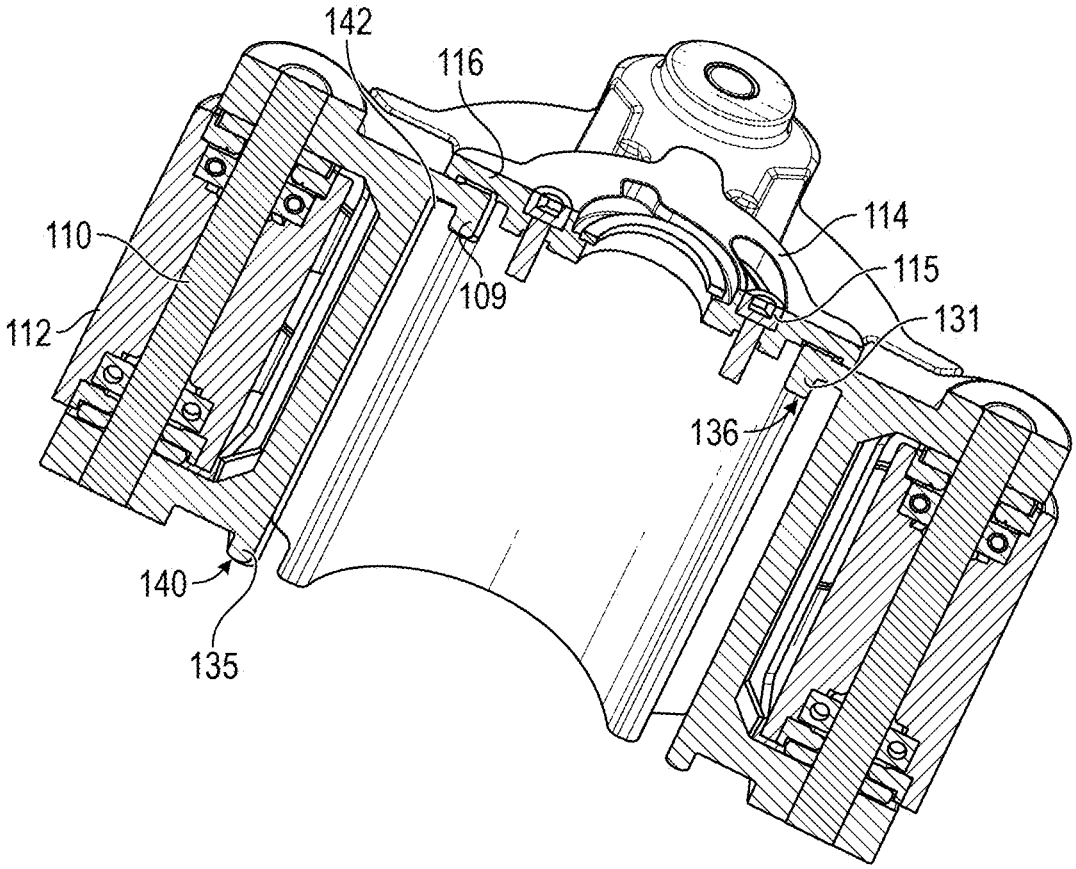
FIG. 7 shows a longitudinal cross-section of the rotor assembly of FIG. 3A.

FIG. 7 is a longitudinal cross-sectional view of the roller assembly 100 of FIG. 3A. The tab 116 is shown in the locked configuration, whereby the arm portion 109 of the roller assembly 104 is pinned between the tab 116 and the abutment surface 142. The hook 131 of the frame 108 is seated within recess 136 of the hub 102. In some aspects, the recess 136 and the hook 131 can constrain movement of the roller assembly 104 relative to the hub 102 in the radial direction of the hub 102. The toe 135 of the roller assembly extends through the opening 140, as described herein.

Figure 8A:
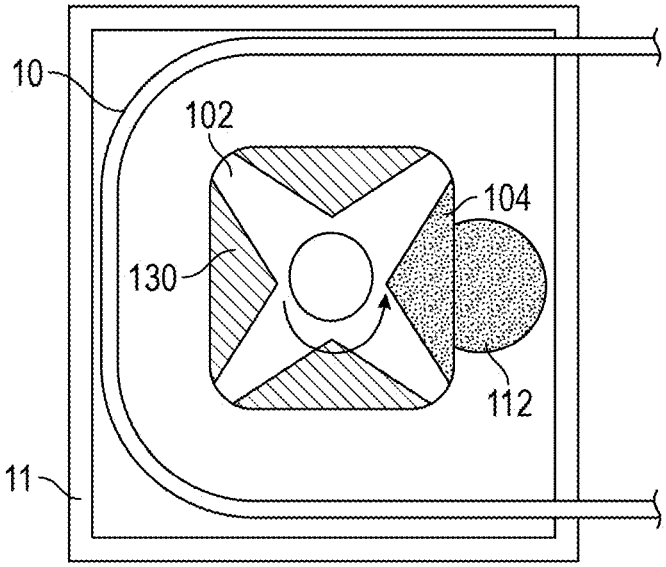
FIGS. 8A-8D show a schematic representation of a method of loading a pump tubing onto a rotor assembly according to some aspects of the present disclosure.
Figure 8B:
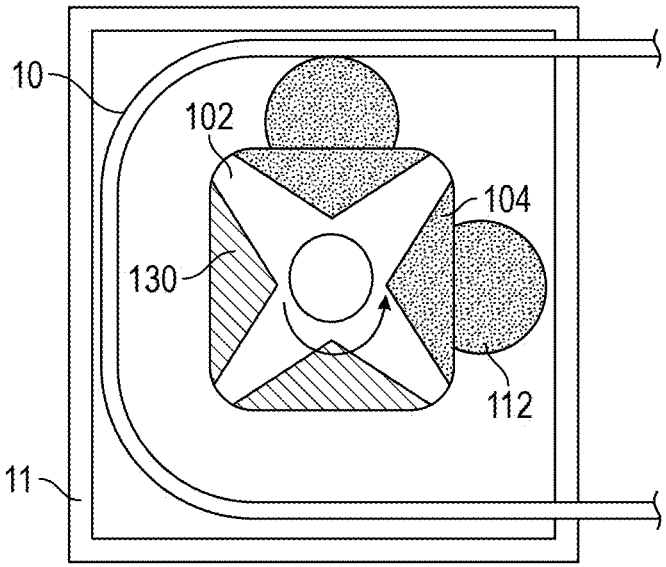
Figure 8C:
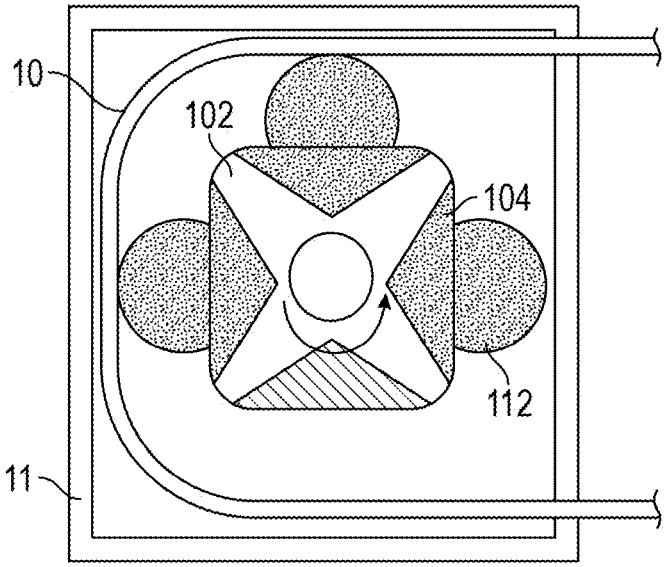
Figure 8D:
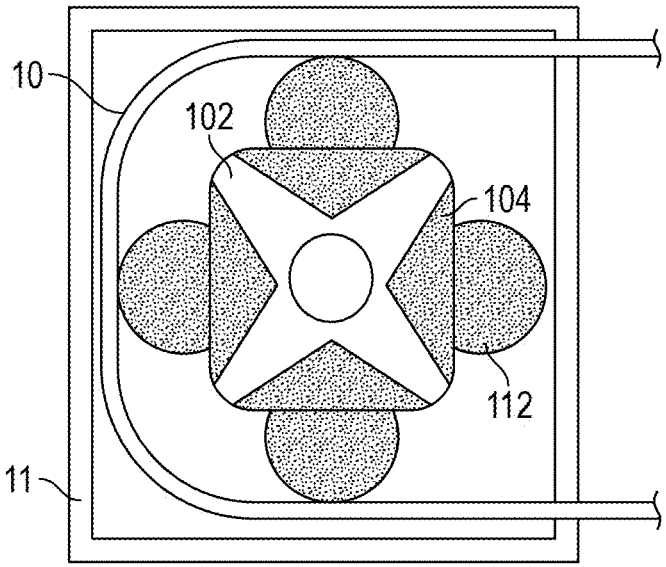

FIGS. 8A-8D illustrate a method of loading a pump tubing 10 into a pump head of a peristaltic pump having a rotor assembly 100 according to some aspects of the present disclosure. The hub 102 can be coupled (e.g., mounted) onto the drive shaft of the pump with one or more of the roller assemblies 104 removed from the hub 102. The tubing 10 can be placed or positioned between the hub 102 and the housing 11 of the pump head while one or more roller assemblies 104 are vacant from one or more receiving slots 130 (e.g., removed from the hub 102). In the illustrated embodiment, one roller assembly 104 is attached to the hub 102 and the other three receiving portions (e.g., slot 130) of the hub 102 are vacant. As can be appreciated with reference to FIG. 8A, the removal of one or more roller assemblies 104 from the hub 102 can facilitate loading the tubing 10 between the hub 102 and the housing 11 of the pump head by providing more clearance for the tubing 10 to fit between the roller 112 of the roller assembly 104 and the housing 11 of the pump head. With reference to FIGS. 8B-8D, the roller assemblies 104 can be added to the hub 102 (e.g., placed and secured in a receiving slot 130) one at a time as the hub 102 is rotated. Rotation of the hub 102 can bring the roller assembly 104 into contact with the tubing 10 to compress (e.g., pinch) the tubing 10 between the roller 112 and the housing 11. This serial addition of the roller assemblies 104 to the hub 102 can reduce or eliminate the likelihood of pinching the fingers of a user while loading the tubing 10 onto a pump head of a peristaltic pump.

In various implementations, a method of loading a piece of tubing into a peristaltic pump is provided. The method can include coupling a hub 102 to a drive shaft of the pump. The hub 102 can have at least one interface surface (e.g., slot 130) configured to cooperate with at least one interface surface (e.g., frame 108) of a roller assembly 104. The method can include placing the piece of tubing between the hub 102 and a housing of the pump with a roller assembly 104 not engaged with the interface surface of the hub 102. The method can include positioning the roller assembly 104 into engagement with the hub 102, so that the interface surface of the hub 102 engages the interface surface of the roller assembly 104. The method can include securing the roller assembly 104 with respect to the hub 102, so that the interface surface of the hub 102 is engaged with the interface surface of the roller assembly 104. The method can also include rotating the hub 102 to compress the tubing against the housing with a roller 112 of the roller assembly 104.

In various instances, the method can also include positioning a second roller assembly 104 into engagement with the hub 102, so that a second interface surface of the hub 102 engages the interface surface of the second roller assembly 104. The method can include securing the roller assembly 104 into engagement with the hub 102, so that the second interface surface of the hub 102 is engaged the interface surface of the second roller assembly 104. The method can further include rotating the hub 102 to compress the tubing against the housing with the second roller assembly 104.

Figure 9:
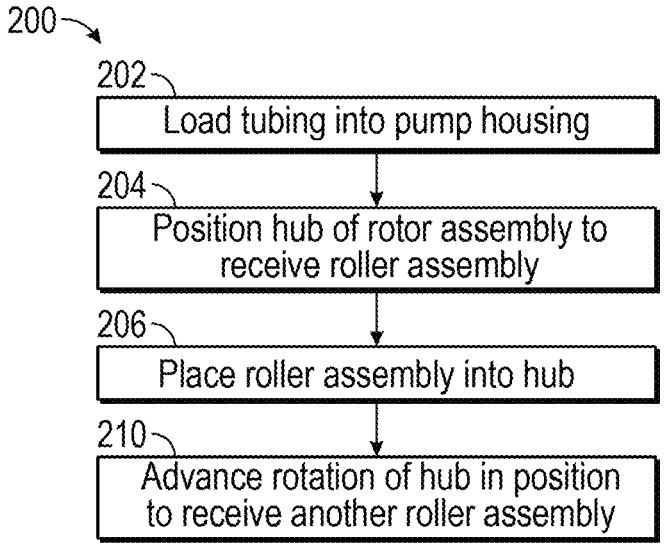
FIG. 9 shows a flowchart representation of a method of loading a pump tubing into a rotor assembly according to some aspects of the present disclosure.

FIG. 9 depicts a method 200 of loading a pump tubing onto a pump head of a peristaltic pump. The method 200 can include the step 202 of loading the tubing into the pump housing. In some aspects, the tubing is loaded into the pump housing by positioning the tubing within the housing such that the tubing encircles at least a portion of the hub 102 with the hub 102 coupled to the drive shaft of the pump. In some aspects the method 200 further includes the step 204 of positioning the hub 102 such that a receiving portion of the hub, such as vacant receiving portion of the hub 102, and specifically the slot 130, is available to receive a roller assembly 104. In some aspects, the method 200 further includes the step 206 of placing or coupling a roller assembly 104 to a vacant receiving portion of the hub 102. In some aspects, the method 200 further includes the step 210 of advancing a rotation of the hub 102 on the drive shaft to bring another vacant receiving portion of the hub 102 in position to receive a roller assembly 104. The method 200 can further include repeating step 204, step 206, and step 210 until all receiving portions of the hub 102 hold a roller assembly 104.

Offset Rollers

Figure 10:
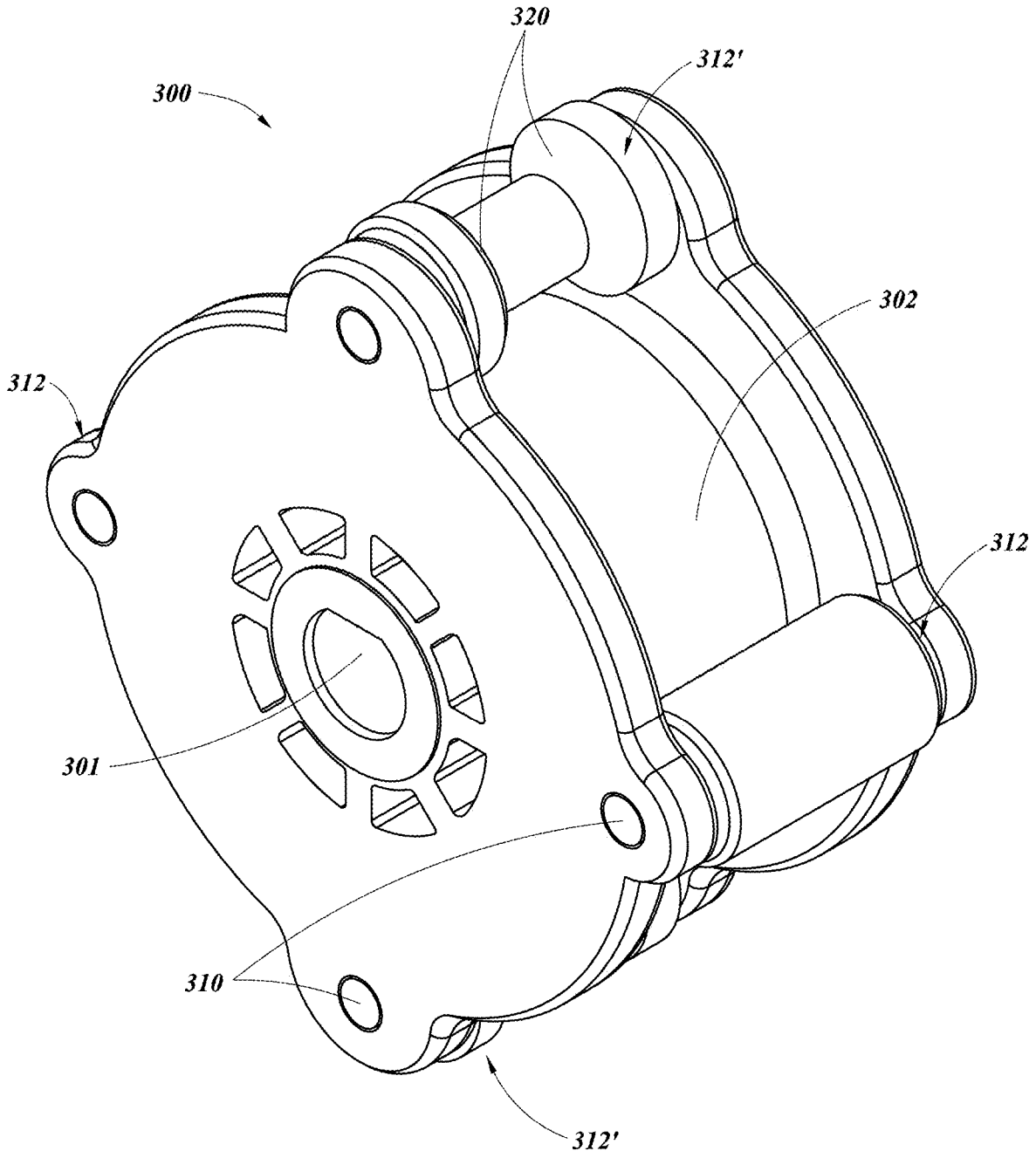
FIG. 10 shows an example rotor assembly.

As described with respect to FIG. 3A, the rollers 112, 112' of the rotor assembly 100 can have different sizes (e.g., diameters). For example, roller 112 can have a larger diameter than roller 112'. FIG. 10 shows another example rotor assembly 300 with different sized rollers 312, 312' in accordance with various embodiments describe herein.

The rotor assembly 300 can include at least one compression roller 312 and at least one alignment roller 312'. The rollers 312, 312' can be mounted on an axle 310. In this example, there are two compression rollers 312 and two alignment rollers 312' that alternate around the center 301 of the hub 302 of the rotor assembly 300. The compression roller 312 can have a larger diameter than the alignment roller 312'. In some instances, the alignment roller 312' can have a smaller diameter surface bound by two side edges 320. The rotor assembly 300 comprising the compression and alignment rollers 312, 312' can include any one or more of the features shown and described herein, e.g., such as those shown and described in connection with FIGS. 1-7. The compression and alignment rollers 312, 312' can be assembled to the hub 302 using any one or more of the method steps shown and described herein, e.g., such as those shown and described in connection with FIGS. 8A-9.

Figure 12:
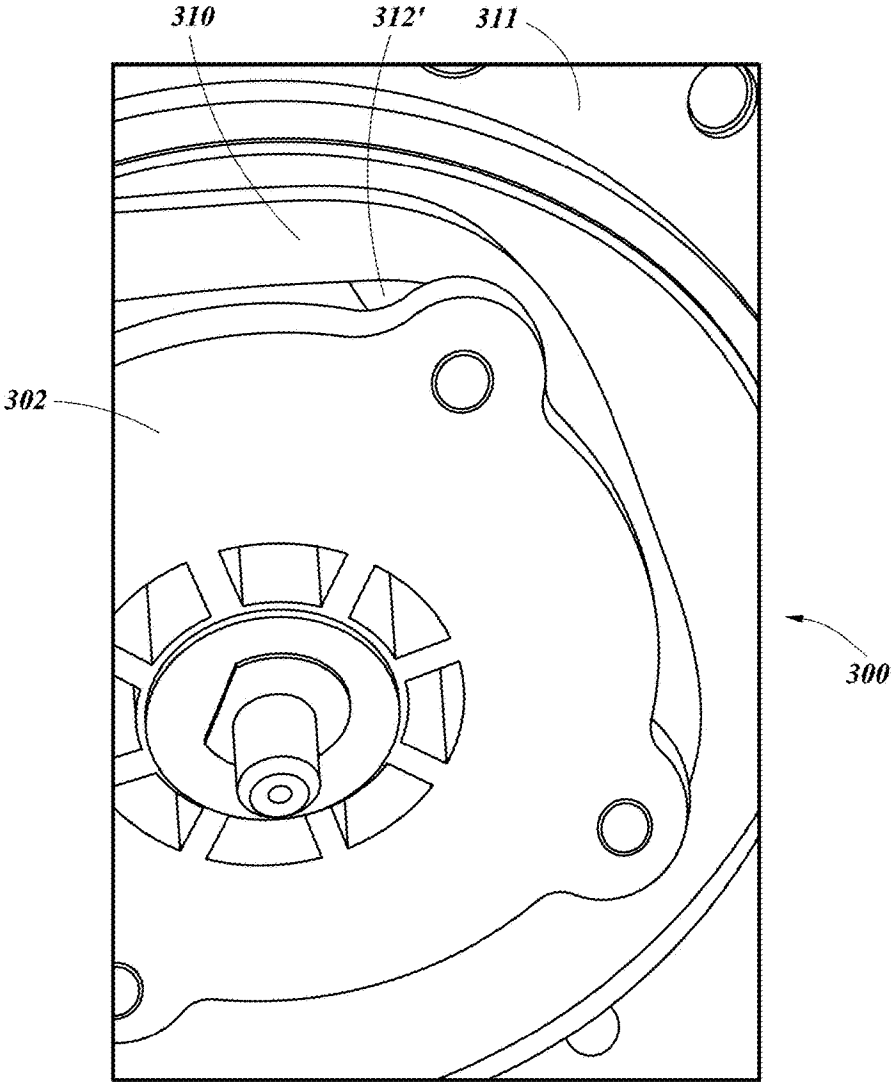
FIG. 12 shows an example alignment roller within a pump head.
Figure 11:
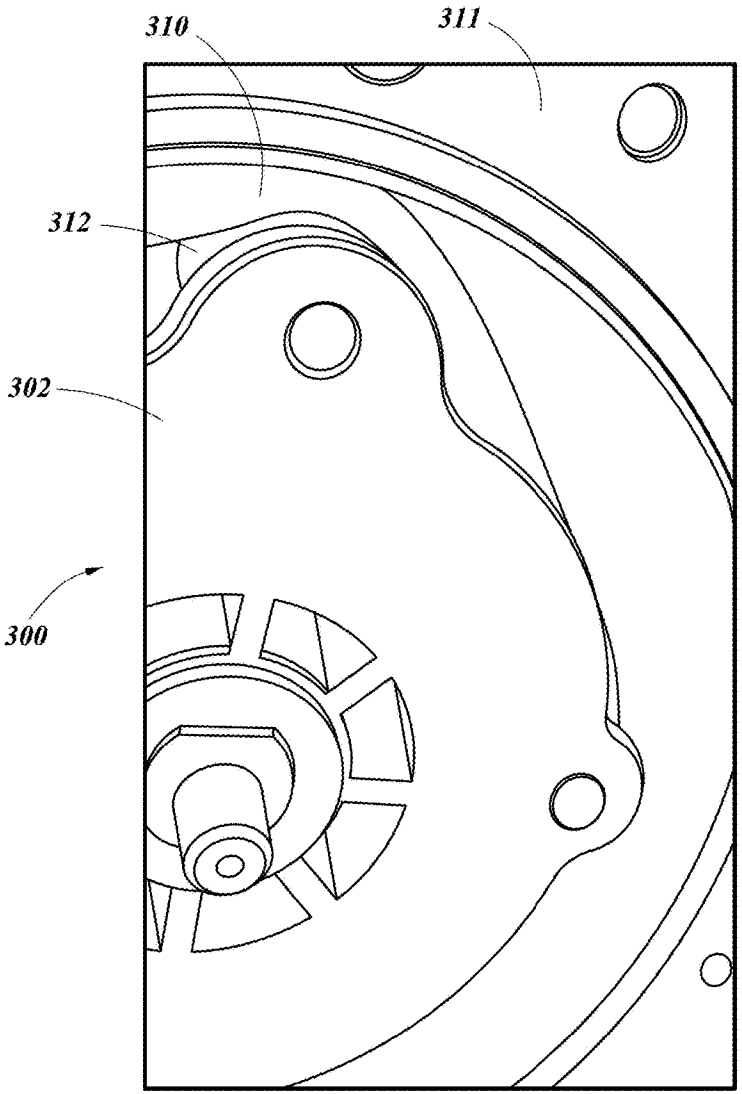
FIG. 11 shows an example compression roller within a pump head.

With reference to FIG. 11, as the rotor assembly 300 rotates, the compression roller 312 of the rotor assembly 300 can be configured to compress and release the tubing 310 against the housing 311 of the pump head to move fluid through the tubing orifice. For example, the fluid within the tubing 310 ahead of the compressed area can move as rotor assembly 300 rotates. In various instances, the compression roller 312 can be configured to cause the tubing 310 (e.g., the inner diameter of the tubing 310) to collapse so that fluid moves in one direction. With reference to FIG. 12, the alignment roller 312' can be configured to help the tubing 310 be aligned (e.g., centered) on the hub 302. For example, as the rotor assembly 300 rotates, the alignment roller 312' can guide the tubing 310 between the two side edges 320 (shown in FIG. 10) of the alignment roller 312'. In various instances, the alignment roller 312' can be configured to cause the tubing 310 to collapse no more than 50%, no more than 40%, no more than 30%, no more than 20%, no more than 10%, or no more than 5% of the inner diameter of the tubing 310. The alignment roller 312' can also be configured to reduce and/or prevent the tubing 310 from rubbing against the surface of the rotor assembly 300 (e.g., the hub 302 of the rotor assembly 300) as the rotor assembly 300 rotates.

Figure 13:
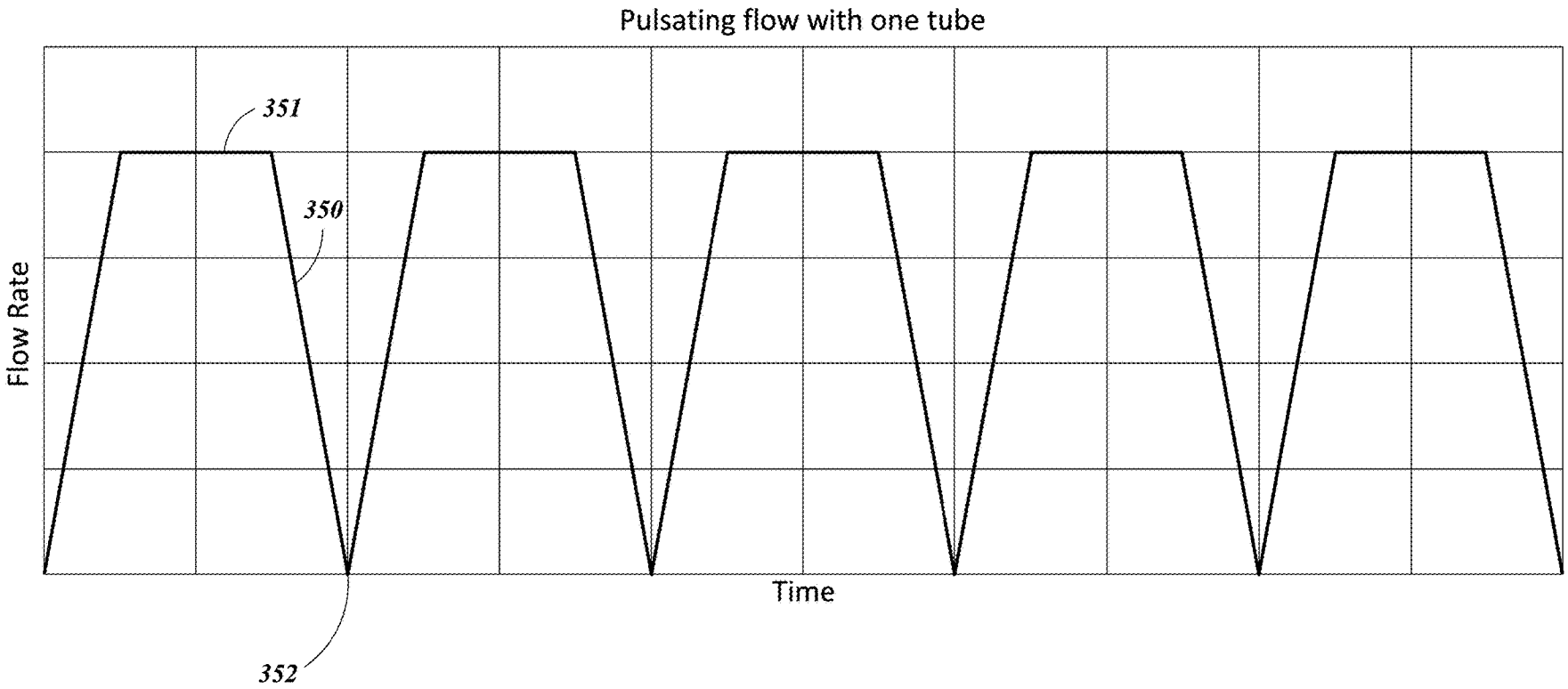
FIG. 13 shows the pulsating flow rate over time of fluid within a tubing.

FIG. 13 shows the flow of the fluid within the tubing 310, e.g., the flow rate 350 of the fluid over time as the compression roller 312 compresses and releases the tubing 310. The flow rate 350 increases to a maximum 351, decreases to a minimum 352, and repeats the cycle as the next compression roller 312 compresses and releases the tubing 310. In various instances, the flow can drop to zero. This period can occur after one compression roller 312 has released the tubing 310 and the other compression roller 312 has initiated contact with the tubing 310.

The repeating change of energy from the acceleration and deceleration of the fluid being moved can cause pulsation. The amount of pulsation can be determined by the amplitude and frequency caused by the pump.

In some instances, problems can occur with pulsating flow. For example, rapid pulsation can cause stress on a water treatment system and potentially cause component failure. Flow measure can be affected by pulsation, which can lead to inaccurate readings. One way to address pulsation can be to average the flow rate in a flow meter. However, this may cause a slow response time for the pump. For example, a pump being paced by a flow meter may have to wait for the flow meter to average out the readings to respond. If a pump is dispensing too much or too little fluid, it may continue to do so until the flow meter averages to its trigger point.

Figure 14:
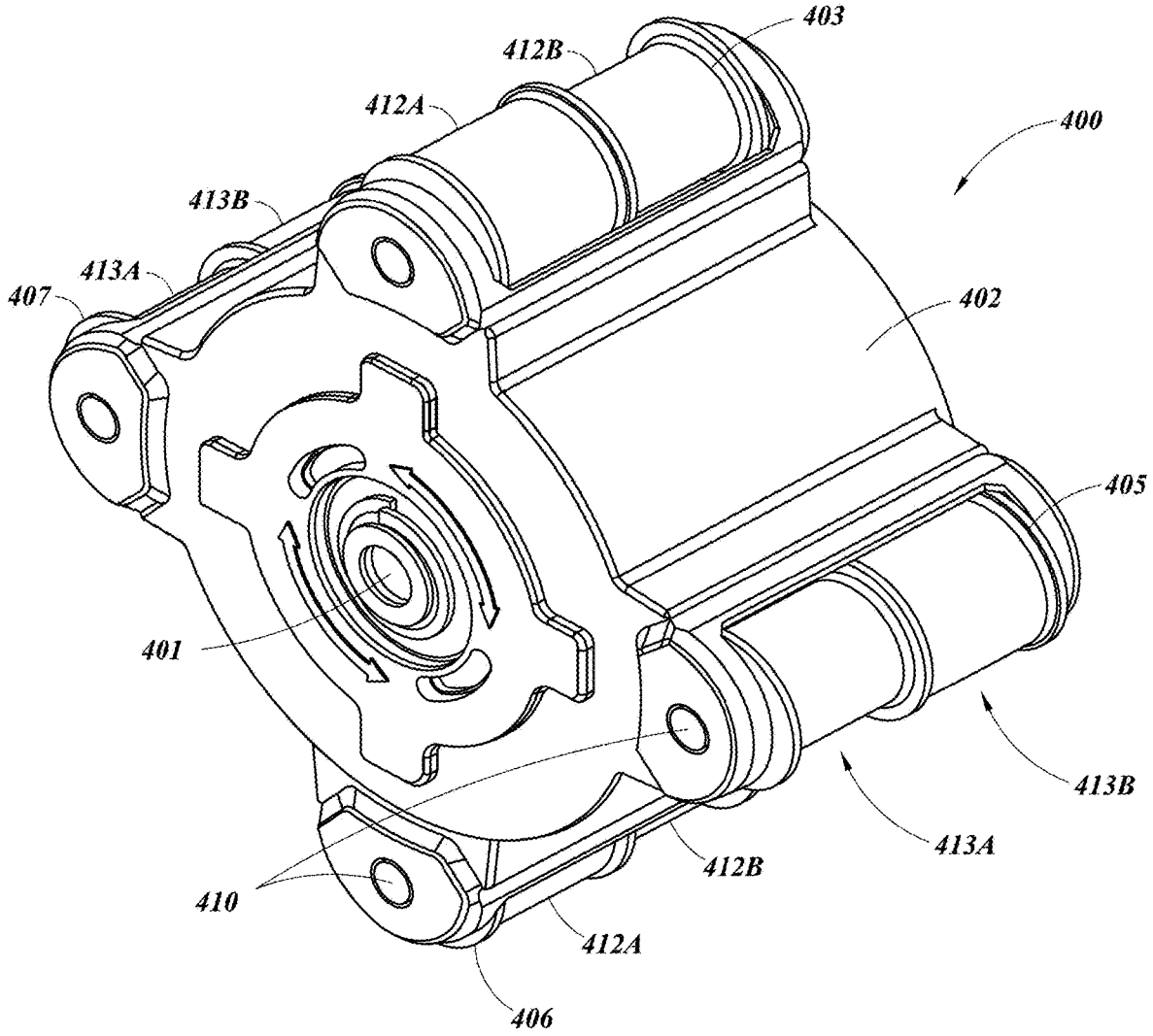
FIG. 14 shows an example rotor assembly configured to reduce pulsation.

FIG. 14 shows an example rotor assembly 400 configured to reduce pulsation. Instead of having separate compression and alignment rollers, roller assemblies can have both a compression portion and an alignment portion to form the roller. For example, roller assemblies can be mounted on a hub of a rotor assembly such that the compression portion of one roller assembly can be offset from the compression portion of another roller assembly, and the alignment portion of one roller assembly can be offset from the alignment portion of another roller assembly.

As an example, the rotor assembly 400 includes a hub 402, a first pair 403, 406 of roller assemblies and a second pair 405, 407 of roller assemblies. The hub 402 can be securable to a drive shaft extending from a motor within a pump body. The hub 402 can be secured to the drive shaft (e.g., through the center 401 of the hub 402) and can be rotatable therewith.

Each of the first pair 403, 406 of roller assemblies can include a first roller portion 412A (e.g., a compression portion) and a second roller portion 412B (e.g., an alignment portion). As shown in FIG. 14, the first roller portion 412A can have a constant diameter and the second roller portion 412B can have a constant diameter with the diameter of the first roller portion being larger than the diameter of the second roller portion. Each of the second pair 405, 407 of roller assemblies can include a first roller portion 413A (e.g., an alignment portion) and a second roller portion 413B (e.g., a compression portion). As shown in FIG. 14, the first roller portion 413A can have a constant diameter and the second roller portion 413B can have a constant diameter with the diameter of the first roller portion being smaller than the diameter of the second roller portion. In various implementations, the roller portions 412A, 412B, 413A, 413B can include roller seats which tend to axially segregate the tubes from one another. For example, a roller portion can include a minimum diameter bound by two side edges. As shown in FIG. 14, in the first pair 403, 406 of roller assemblies, the minimum diameter of the first roller portion 412A can be larger than the minimum diameter of the second roller portion 412B. As shown in FIG. 14, in the second pair 405, 407 of roller assemblies, the minimum diameter of the first roller portion 413A can be smaller than the minimum diameter of the second roller portion 413B.

The first pair 403, 406 of roller assemblies and the second pair 405, 407 of roller assemblies can be positionable along the perimeter of a tubing channel, such as around a circumference of the hub 402 so that each one of the first pair 403, 406 of roller assemblies can be positioned between the second pair 405, 407 of roller assemblies, and the first roller portion 412A of the first pair 403, 406 of roller assemblies can be aligned with the first roller portion 413A of the second pair 405, 407 of roller assemblies and the second roller portion 412B of the first pair 403, 406 of roller assemblies can be aligned with the second roller portion 413B of the second pair 405, 407 of roller assemblies. In various implementations, the compression portions of the first pair 403, 406 of roller assemblies can be aligned with the alignment portions of the second pair 405, 407 of roller assemblies, and the alignment portions of the first pair 403, 406 of the roller assemblies can be aligned with the compression portions of the second pair 405, 407 of roller assemblies. In various instances, the compression portions of the first pair 403, 406 of roller assemblies can be offset from the compression portions of the second pair 405, 407 of roller assemblies and the alignment portions of the first pair 403, 406 of roller assemblies can be offset from the alignment portions of the second pair 405, 407 of roller assemblies.

In various implementations, each of the first roller portions 412A of the first pair 403, 406 of roller assemblies can be the same in size (e.g., diameter) and shape. In other instances, each of the first roller portions 412A of the first pair 403, 406 of roller assemblies can be of different size (e.g., diameter) and shape.

In various implementations, each of the second roller portions 412B of the first pair 403, 406 of roller assemblies can be the same in size (e.g., diameter) and shape. In other instances, each of the second roller portions 412B of the first pair 403, 406 of roller assemblies can be of different size (e.g., diameter) and shape.

In various implementations, each of the first roller portions 413A of the second pair 405, 407 of roller assemblies can be the same in size (e.g., diameter) and shape. In other instances, each of the first roller portions 413A of the second pair 405, 407 of roller assemblies can be of different size (e.g., diameter) and shape.

In various implementations, each of the second roller portions 413B of the second pair 405, 407 of roller assemblies can be the same in size (e.g., diameter) and shape. In other instances, each of the second roller portions 413B of the second pair 405, 407 of roller assemblies can be of different size (e.g., diameter) and shape.

The roller assemblies 403, 405, 406, 407 can be mounted on a respective axle 410 on the hub 402 of the rotor assembly 400. The rotor assembly 400 with the roller assemblies 403, 405, 406, 407 can be disposed in the pump head as shown and described herein, e.g., such as with respect to FIGS. 1A-1B, 2A, and 8A-8D. For example, FIG. 15A shows the rotor assembly 400 within a pump head. The pump head can include a first station 418 and a second station 419 similar to those shown and described herein, e.g., such as with respect to FIGS. 1B and 2A. For example, the first station 418 can include (1) a first tube portion 418A configured to receive a first tube 421 (and/or a first tube connector section) and (2) a second tube portion 418B configured to receive a second tube 422 (and/or a second tube connector section). As another example, the second station 419 can include (1) a first tube portion 419A configured to receive a first tube 421 (and/or a first tube connector section) and (2) a second tube portion 419B configured to receive a second tube 422 (and/or a second tube connector section).

Figure 15B:
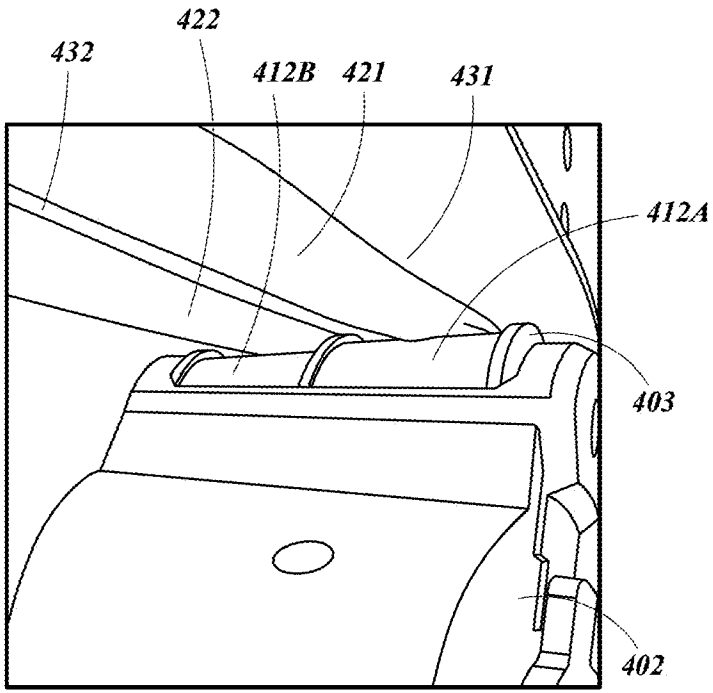
FIG. 15B shows a close up view of the pump head in FIG. 15A above the roller assembly.
Figure 15A:
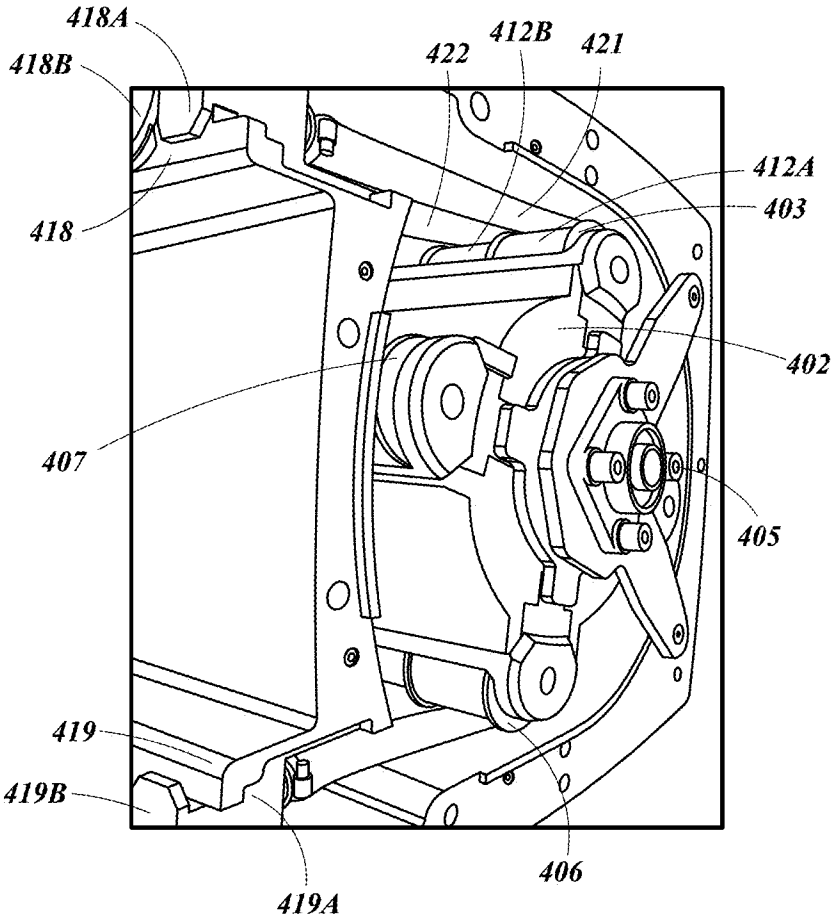
FIG. 15A shows the example rotor assembly in FIG. 14 within a pump head.

FIG. 15B shows a close up view of the pump head above the roller assembly. The first tube 421 can be positioned over the compression portion (e.g., 412A) of the roller assembly 403, and the second tube 422 can be positioned over the alignment portion (e.g., 412B) of the roller assembly 403. The pump head can include a first outer tube interface surface portion 431 positioned to contact the first tube 421 extending between the first station 418 and the second station 419. The pump head can also include a second outer tube interface surface portion 432 positioned to contact the second tube 422 extending between the first station 418 and the second station 419.

In various implementations, with reference to FIGS. 14 and 15A-15B, the first roller portion 412A of the first pair 403, 406 of roller assemblies and the first roller portion 413A of the second pair 405, 407 of roller assemblies can be configured to selectively compress tubing 421 against the first outer tube interface surface 431 and the second roller portion 412B of the first pair 403, 406 of roller assemblies and the second roller portion 413B of the second pair 405, 407 of roller assemblies can be configured to selectively compress tubing 422 against the second outer tube interface surface 432. For example, in various instances, the compression portion of the roller can be configured to cause tubing (e.g., the inner diameter of tubing) to collapse so that fluid moves in one direction. In various instances, the alignment portion of the roller can be configured to cause the tubing to collapse no more than 50%, no more than 40%, no more than 30%, no more than 20%, no more than 10%, or no more than 5% of the inner diameter of tubing.

In various instances, the first roller portion 412A and the second roller portion 412B of each of the first pair 403, 406 of roller assemblies can be connected to rotate together (e.g., through an axle 410). In various instances, the first roller portion 413A and the second roller portion 413B of each of the second pair 405, 407 of roller assemblies can be connected to rotate together (e.g., by having the first roller portion keyed to the second roller portion).

In some implementations, the first roller portion 412A and the second roller portion 412B of each of the first pair 403, 406 of roller assemblies can form a continuous integral piece, e.g., forming a single roller. In some implementations, the first roller portion 413A and the second roller portion 413B of the second pair 405, 407 of roller assemblies can form a continuous integral piece, e.g., forming a single roller.

In some implementations, the first roller portion 412A and the second roller portion 412B of each of the first pair 403, 406 of roller assemblies can be separate pieces. In some implementations, the first roller portion 413A and the second roller portion 413B of the second pair 405, 407 of roller assemblies can be separate pieces.

Desirably, the first roller portion and the second roller portion together are almost as large or larger than twice the largest tube to be used. This can be roughly approximated by the width of the tube station. Specifically, (1) the combined axial width of the first roller portion and the second roller portion of the first pair of roller assemblies is at least 70%, at least 80%, at least 90% or at least 100% of the axial width of the first tube station and (2) the combined axial width of the first roller portion and the second roller portion of the second pair of roller assemblies is least 70%, at least 80%, at least 90% or at least 100% of the axial width of the second tube station. In addition, desirably (1) the combined axial width of the first roller seat and the second roller seat of the first pair of roller assemblies is at least 70%, at least 80%, at least 90% or at least 100% of the axial width of the first tube station and (2) the combined axial width of the first roller seat and the second roller seat of the second pair of roller assemblies is least 70%, at least 80%, at least 90% or at least 100% of the axial width of the second tube station.

The rotor assembly 400 can also include any one or more features of the rotor assembly 100 shown and described herein, e.g., such as with respect to FIGS. 1A-7 or of the rotor assembly 300 shown and described herein, e.g., such as with respect to FIG. 10. For example, as shown and described with respect to FIGS. 3C, the rotor assembly can include a hub 102 comprising hub interface surfaces 130 that extend longitudinally along the hub 102. Each of the roller assemblies can comprise a support frame 108, an axle 110 and the roller portions. Each of the roller assemblies further can comprise a roller assembly interface surface configured to slide longitudinally along one of the hub interface surfaces 130 to seat one of the roller assemblies onto the hub 102.

In addition, roller assemblies 403, 405, 406, 407 can be assembled on the hub 402 using any one or more of the method steps shown and described herein, e.g., such as in connection with FIGS. 8A-9.

As described herein, each roller of the roller assemblies can have one side configured as a compression roller and the other side configured as an alignment roller. The roller assemblies can be mounted on the hub 402 such that the compression and alignment portions alternate about the hub 402 of the roller assembly 400. Two tubings 421, 422 can be used, for example, one on each side of the rollers (e.g., as shown in FIG. 15B, one tubing 421 can be disposed over the compression portion 412A and another tubing 422 can be disposed over the alignment portion 412B). As the rotor assembly 400 rotates about the center 401, the roller assemblies can offset the flow phases.

Figure 16:
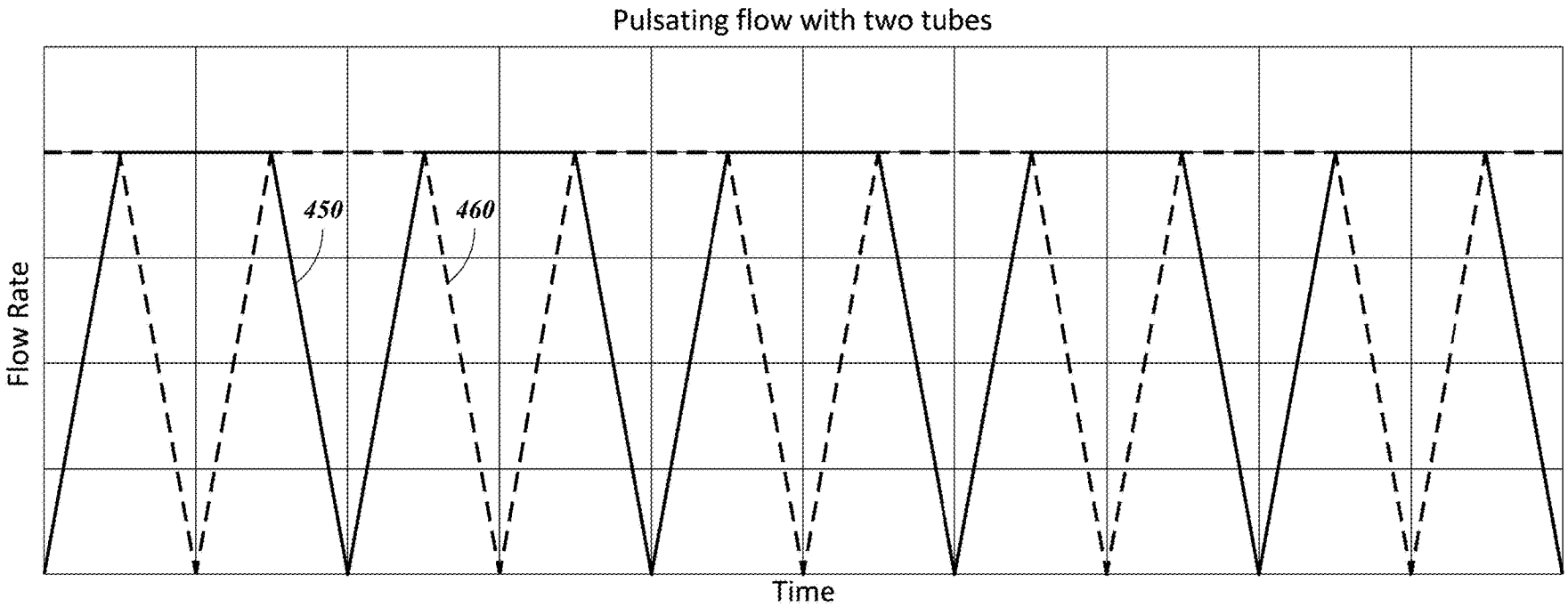
FIG. 16 shows the flow rate over time of fluid using an example rotor assembly as described herein.

For example, FIG. 16 shows the flow rate over time with the two tubings. The flow 450 of the fluid in the first tubing is similar to that shown in FIG. 13. The flow 460 of the fluid in the second tubing is similar in shape, but offset in phase from the flow 450 in the first tubing.

Having the fluid flow in the tubings in different phases can be achieved through the roller assemblies described herein. While one tubing is in a cycle of changing the fluid velocity, the other tubing is delivering fluid. Although examples show only two tubes, other implementation can include more than two tubes. For example, some implementations can include additional tubes disposed over roller assemblies with additional compression and/or alignment portions. In some implementations, as shown in FIG. 2A, the plurality of tubes can be connected to a plurality of inlets and/or outlets. In other implementations, as shown in FIG. 2B, the plurality of tubes can be connected to a single inlet and/or outlet.

In some instances, each individual tube can be removed and/or replaced individually from the pump head. In some instances, the plurality of tubes can be removed and/or replaced as a unit (e.g., connected together). In some instances, the tube connectors can be removed and/or replaced with the plurality of tubes attached. Various designs are possible.

In addition, although examples show rotor assemblies with four roller assemblies, some implementations can include more or less roller assemblies. For example, some rotor assemblies can include additional pairs of roller assemblies. As another example, some rotor assemblies may include only two roller assemblies. Various designs are possible.

Advantageously, various implementations can reduce the change of energy being applied to the system and can reduce the risk of failure occurring. Flow rate can also be smoother and flow devices can react faster as the change of flow does not happen as rapidly. In some embodiments, the pulse volume can be reduced by half using offset rollers as described herein.

As described herein, pulsation can cause damage and inaccuracies in a water treatment system. For example, damage to a system can be catastrophic and harm a person or can cause water to not be treated. Inaccuracies can lead to improper treatment of water and wastewater. In various cases, users purchase large pulsation dampeners to compensate for pulses. This can add cost and complexity to water treatment systems. In various implementations described herein, using offset rollers can reduce the stress caused by pulsation and help ensure equipment runs properly and is safe to use. Various embodiments described herein can also reduce the need for pulsation dampeners resulting in simpler designs and lower costs.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. A peristaltic pump assembly, comprising:

a pump head, comprising:

a first station, the first station including (1) a first tube portion configured to receive a first tube and/or a first tube connector section and (2) a second tube portion configured to receive a second tube and/or a second tube connector section;

a second station, the second station including (1) a first tube portion configured to receive a first tube and/or a first tube connector section and (2) a second tube portion configured to receive a second tube and/or a second tube connector section;

a first outer tube interface surface portion positioned to contact a first tube extending between the first station and the second station;

a second outer tube interface surface portion positioned to contact a second tube extending between the first station and the second station;

a motor having a drive shaft; and a rotor connectable to the drive shaft so as to be rotatable therewith, the rotor comprising:

a first pair of roller assemblies and a second pair of roller assemblies, each of the first pair of roller assemblies including a first roller portion having a first diameter and a second roller portion having a second diameter, wherein the first diameter is larger than the second diameter, each of said first pair of roller assemblies comprising a first side edge and a second side edge on either side of the first roller portion and extending radially outward therefrom, each of said first pair of roller assemblies further comprising a third side edge and a fourth side edge on either side of the second roller portion and extending radially outward therefrom; and each of the second pair of roller assemblies including a first roller portion having a first diameter and a second roller portion having a second diameter, wherein the first diameter is smaller than the second diameter, each of said second pair of roller assemblies comprising a first side edge and a second side edge on either side of the first roller portion and extending radially outward therefrom, each of said second pair of roller assemblies further comprising a third side edge and a fourth side edge on either side of the second roller portion and extending radially outward therefrom;

wherein the first pair of roller assemblies and the second pair of roller assemblies are positionable around a circumference of the rotor such that each one of the first pair of roller assemblies is positioned around the circumference of the rotor and is directly proceeded by one of the second pair of roller assemblies and is directly followed by the other of the second pair of roller assemblies, and the first roller portion of the first pair of roller assemblies is aligned with the first roller portion of the second pair of roller assemblies and the second roller portion of the first pair of roller assemblies is aligned with the second roller portion of the second pair of roller assemblies;

wherein the first roller portion of the first pair of roller assemblies and the first roller portion of the second pair of roller assemblies are configured to selectively compress tubing against the first outer tube interface surface portion and the second roller portion of the first pair of roller assemblies and the second roller portion of the second pair of roller assemblies are configured to selectively compress tubing against the second outer tube interface surface portion.

2. The peristaltic pump assembly of claim 1, wherein the first roller portion and the second roller portion of each of the first pair of roller assemblies are connected to rotate together and the first roller portion and the second roller portion of each of the second pair of roller assemblies are connected to rotate together.

3. The peristaltic pump assembly of claim 1, wherein the first roller portion and the second roller portion of each of the first pair of roller assemblies form a continuous integral piece and the first roller portion and the second roller portion of each of the second pair of roller assemblies form a continuous integral piece.

4. The peristaltic pump assembly of claim 1, wherein (1) the combined axial width of the first roller portion and the second roller portion of the first pair of roller assemblies is at least 70% of the axial width of the first station and (2) the combined axial width of the first roller portion and the second roller portion of the second pair of roller assemblies is least 70% of the axial width of the second station.

5. The peristaltic pump assembly of claim 1, wherein the rotor comprises a hub comprising at least a first pair of hub interface surfaces that extend longitudinally along the hub; and each of the first pair of roller assemblies comprises a first support frame, a first axle and a first roller, each of the first pair of first roller assemblies further comprising a first roller assembly interface surface configured to slide longitudinally along one of the first pair of hub interface surfaces to seat one of the first pair of roller assemblies onto the hub.

6. The peristaltic pump assembly of claim 1, wherein the rotor comprises a hub further comprising at least a second pair of hub interface surfaces that extend longitudinally along the hub; and each of the second pair of roller assemblies comprises a second support frame, a second axle and a second roller, each of the second pair of second roller assemblies further comprising a second roller assembly interface surface configured to slide longitudinally along one of the second pair of hub interface surfaces to seat one of the second pair of roller assemblies onto the hub.

* * * * *